US007696447B2

(12) United States Patent
Chen et al.

(10) Patent No.: US 7,696,447 B2
(45) Date of Patent: Apr. 13, 2010

(54) ELECTRICAL SWITCHING APPARATUS AND STORED ENERGY ASSEMBLY THEREFOR

(75) Inventors: Steven Z. Chen, Moon Township, PA (US); James J. Benke, Pittsburgh, PA (US); Alan K. Edmunds, Bellevue, PA (US); Daniel E. Palmieri, Aliquippa, PA (US); Paul T. Bottegal, Lower Burrell, PA (US)

(73) Assignee: Eaton Corporation, Cleveland, OH (US)

( * ) Notice: Subject to any disclaimer, the term of this patent is extended or adjusted under 35 U.S.C. 154(b) by 362 days.

(21) Appl. No.: 11/756,666

(22) Filed: Jun. 1, 2007

(65) Prior Publication Data

US 2008/0296137 A1 Dec. 4, 2008

(51) Int. Cl.
*H01H 5/00* (2006.01)

(52) U.S. Cl. ..... 200/400; 200/401; 218/153; 218/154; 335/171

(58) Field of Classification Search ..... 200/400, 200/401, 244, 17 R, 48 R; 218/153, 154, 218/140, 7, 14; 335/6–16, 170–175
See application file for complete search history.

(56) References Cited

U.S. PATENT DOCUMENTS 4,683,451 A 7/1987 Grunert et al.
4,743,876 A 5/1988 Milianowicz et al.
5,938,008 A * 8/1999 Wehrli et al. ..... 200/400
6,486,758 B1 11/2002 Olszewski et al.
6,864,450 B1 3/2005 Chen et al.

* cited by examiner

*Primary Examiner*—Renee S Luebke
*Assistant Examiner*—Marina Fishman
(74) *Attorney, Agent, or Firm*—Martin J. Moran

(57) ABSTRACT

A stored energy assembly is provided for an electrical switching apparatus, such as a circuit breaker. The stored energy assembly includes a mount removably coupled to the circuit breaker housing. A stored energy mechanism, such as a spring, is coupled to the mount and is movable among charged and discharged positions. An actuating element is cooperable with the gears of a gear assembly in order to move among first and second positions corresponding to the spring being disposed in the charged and discharged positions, respectively. A manual charging mechanism and an automatic charging mechanism are coupled to the gear assembly, and move the gears, in order to move the actuating element and charge the spring. The spring, the actuating element, the gear assembly, and the charging mechanisms are coupled to the mount, thereby forming a sub-assembly. The sub-assembly is removeably coupled to the circuit breaker housing.

12 Claims, 11 Drawing Sheets

ELECTRICAL SWITCHING APPARATUS AND STORED ENERGY ASSEMBLY THEREFOR

CROSS-REFERENCE TO RELATED APPLICATION

This application is related to commonly assigned, concurrently filed: U.S. patent application Ser. No. 11/756,682, filed Jun. 1, 2007, entitled "ELECTRICAL SWITCHING APPARATUS, AND STORED ENERGY ASSEMBLY AND TIME DELAY MECHANISM THEREFOR".

BACKGROUND OF THE INVENTION

1. Field of the Invention

The invention relates generally to electrical switching apparatus and, more particularly, to stored energy assemblies for electrical switching apparatus, such as circuit breakers.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions as detected, for example, by a trip unit.

Some medium voltage circuit breakers, for example, employ a spring-operated stored energy assembly. Specifically, the operating mechanism of such circuit breakers typically includes an opening assembly having at least one spring which facilitates the opening (e.g., separation) of the electrical contact assemblies, a closing assembly including a number of springs that close the electrical contact assemblies, and a charging mechanism for charging the spring(s). The contact assemblies are closed by releasing the stored energy of the closing assembly spring(s). The closing assembly spring(s) is/are charged either manually, using a manual charging mechanism such as, for example, a charging handle, or automatically using, for example, a motor-driven charging mechanism or other suitable electromechanical charging mechanism. Each of the manual and automatic charging mechanisms of known stored energy assemblies requires its own individual "chain" or assembly of components, in order to link the corresponding power source (e.g., human power; motor power) to the spring(s) that must be charged. There are numerous components in each of these assemblies, some of which are relatively complex to make and/or are difficult to install or assemble. Additionally, the components of the manual and automatic charging mechanisms, as well as the other components of the stored energy assembly in general, are typically "built in" with respect to the circuit breaker. In other words, they are individually coupled to various locations on the circuit breaker housing and not readily interchangeable for use in other applications (e.g., with other circuit breakers). This makes it difficult to repair, replace and/or maintain the charging mechanisms because to do so requires the entire circuit breaker to be at least partially disassembled. Moreover, the charging handle for the manual charging mechanism is a relatively large (e.g., long, in order to provide leverage) separate component, which is typically not permanently attached and, therefore, must be stored separate from the circuit breaker, and can be lost.

There is, therefore, room for improvement in electrical switching apparatus, such as circuit breakers, and in stored energy assemblies therefor.

SUMMARY OF THE INVENTION

These needs and others are met by embodiments of the invention, which are directed to a stored energy assembly for an electrical switching apparatus, such as a circuit breaker, which stored energy assembly is self-contained, and is capable of being universally employed in various applications and/or with a wide variety of different circuit breakers.

As one aspect of the invention, a stored energy assembly is provided for an electrical switching apparatus including a housing. The stored energy assembly comprises: a mount structured to be removably coupled to the housing; a stored energy mechanism coupled to the mount and being movable among a charged position and a discharged position; a gear assembly including a plurality of gears; an actuating element being cooperable with the gears in order to charge the stored energy mechanism, the actuating element being movable among a first position corresponding to the stored energy mechanism being disposed in the charged position, and a second position corresponding to the stored energy mechanism being disposed in the discharged position; a first charging mechanism coupled to a corresponding one of the gears; and a second charging mechanism coupled to such corresponding one of the gears. Each of the first charging mechanism and the second charging mechanism is structured to move the gears, in order to move the actuating element and charge the stored energy mechanism. The stored energy mechanism, the actuating element, the gear assembly, the first charging mechanism, and the second charging mechanism are coupled to the mount, thereby forming a sub-assembly which is structured to be removably coupled to the housing of the electrical switching apparatus.

The mount may comprise a first side, a second side, a first end, a second end disposed opposite and distal from the first end, a back structured to be coupled to the housing, and a front structured to be accessible external the housing. The stored energy mechanism may comprise a spring and a mounting assembly structured to mount the spring on the second side of the mount. The spring may have a first end disposed proximate the first end of the mount, a second end extending toward the second end of the mount, and a plurality of coils extending between the first end of the spring and the second end of the spring. The mounting assembly may comprise a first connector extending outwardly from the second side of the mount at or about the first end of the mount, a second connector coupled to the actuating element, and a guide member extending between the first connector and the second connector. The spring may be disposed between the first connector and the second connector, wherein the guide member extends through the coils.

The first charging mechanism may be a manual charging mechanism being operable by hand to charge the spring. The second charging mechanism may be an automatic charging mechanism being operable to automatically charge the spring. The gears may include a first gear coupled to the second side of the mount, a second gear coupled to the automatic charging mechanism, and a third gear coupled to the actuating element and being cooperable with the first gear and the second gear. The manual charging mechanism may be coupled to the automatic charging mechanism, and may be structured to move the automatic charging mechanism in order to move the second gear. The third gear may include a center and a generally circular perimeter, and the actuating element may comprise a planar portion and a protrusion extending perpendicularly outwardly from the planar portion. The planar portion may be coupled to the third gear with the protrusion being disposed between the center and the generally circular perimeter. When the third gear is pivoted and the actuating element is moved toward the first position, protrusion of the actuating element may move the second connector in a first direction to compress the spring and, when the third gear is pivoted and the actuating element is moved toward the second position, the protrusion of the actuating element may move the second connector in a second direction which is generally opposite the first direction, in order to release the spring. The manual charging mechanism may comprise a charging handle and a one-way bearing, and the automatic charging mechanism may comprise an electric motor. The one-way bearing may be disposed between the charging handle and the electric motor, wherein the one-way bearing permits the charging handle to move the electric motor and the gear only when the charging handle is moved in one predetermined direction. The gear assembly may further include a shaft coupled to a corresponding one of the gears, and a one-way clutch coupled to the shaft. The one-way clutch may permit each of the first gear, the second gear, and the third gear to only be operable in one direction.

As another aspect of the invention, an electrical switching apparatus comprises: a housing; separable contacts; an operating mechanism comprising a pivotable pole shaft structured to open and close the separable contacts; and a stored energy assembly comprising: a mount removably coupled to the housing, a stored energy mechanism coupled to the mount and being movable among a charged position and a discharged position, a gear assembly including a plurality of gears, an actuating element being cooperable with the gears in order to charge the stored energy mechanism, the actuating element being movable among a first position corresponding to the stored energy mechanism being disposed in the charged position, and a second position corresponding to the stored energy mechanism being disposed in the discharged position, a first charging mechanism coupled to a corresponding one of the gears, and a second charging mechanism coupled to such corresponding one of the gears. Each of the first charging mechanism and the second charging mechanism moves the gears, in order to move the actuating element and charge the stored energy mechanism. The stored energy mechanism, the actuating element, the gear assembly, the first charging mechanism, and the second charging mechanism are coupled to the mount, thereby forming a sub-assembly which is removably coupled to the housing of the electrical switching apparatus.

The electrical switching apparatus may be a circuit breaker. The housing of the circuit breaker may include a back, a front, first and second opposing sides, a top, and a bottom extending outwardly from the back to form a cavity. The mount of the stored energy assembly may further comprise a number of fasteners, wherein the number of fasteners are fastenable to fasten the sub-assembly of the stored energy assembly to the back of the housing. When the mount of the stored energy assembly is fastened to the back of the housing, the sub-assembly may be disposed within the cavity and, when the sub-assembly is disposed within the cavity, the front of the mount may be accessible at or about the front of the housing of the circuit breaker.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
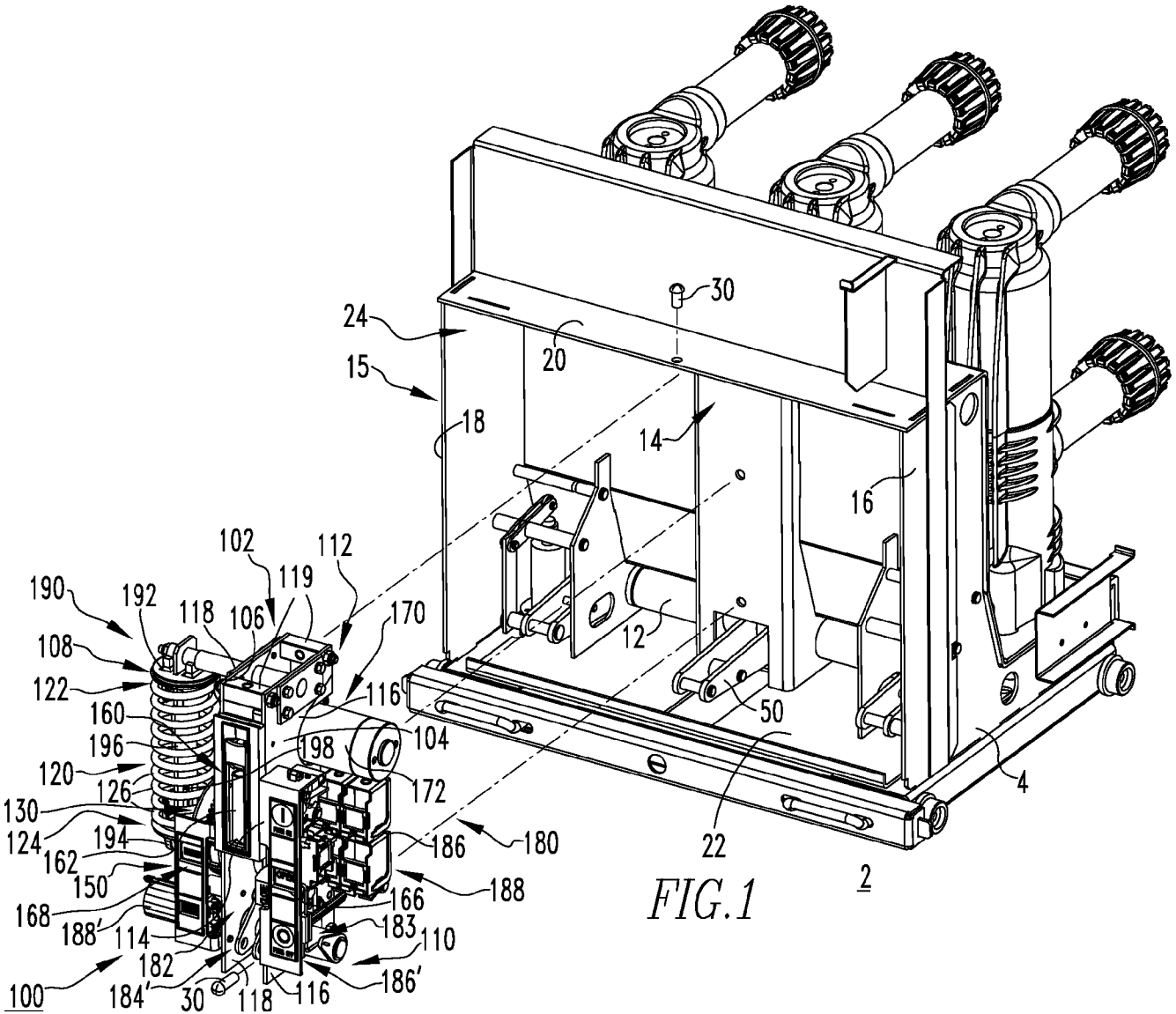
FIG. 1 is a partially exploded isometric view of a circuit breaker and a stored energy assembly therefor, in accordance with an embodiment of the invention.

For purposes of illustration, embodiments of the invention will be described as applied to medium voltage circuit breakers, although it will become apparent that they could also be applied to a wide variety of electrical switching apparatus (e.g., without limitation, circuit switching devices and other circuit interrupters, such as contactors, motor starters, motor controllers and other load controllers) other than medium voltage circuit breakers and other than medium voltage electrical switching apparatus.

Directional phrases used herein, such as, for example, top, bottom, upper, lower, front, back, clockwise, counterclockwise and derivatives thereof, relate to the orientation of the elements shown in the drawings and are not limiting upon the claims unless expressly recited therein.

As employed herein, the phrase "self-contained" refers to the modular nature of the disclosed stored energy assembly, in which substantially all of the components (e.g., without limitation, closing springs; auxiliary switches; charging motors; charging handle) that are traditionally independently coupled to (e.g., "built-in") the electrical switching apparatus, are instead collectively disposed on a single removable sub-assembly.

As employed herein, the term "universal" refers to the ability of the disclosed stored energy assembly to be employed with a wide variety of different circuit breakers.

As employed herein, the terms "actuator" and "actuating element" refer to any known or suitable output mechanism (e.g., without limitation, trip actuator; solenoid) for an electrical switching apparatus (e.g., without limitation, circuit switching devices, circuit breakers and other circuit interrupters, such as contactors, motor starters, motor controllers and other load controllers) and/or the element (e.g., without limitation, stem; plunger; lever; paddle; arm) of such mechanism, which moves in order to manipulate another component of the electrical switching apparatus.

As employed herein, the term "indicator" refers to any known or suitable indicia of the status (e.g., without limitation, tripped; open; closed) of an electrical switching apparatus expressly including, but not limited to, a visual indicator such as a colored indicator, a light emitting diode (LED), a trip flag, a suitable word (e.g., "TRIPPED") or a suitable letter (e.g., "T") or other suitable term or indicia, and audible indicators such as a beep, a tone or other suitable sound. Indicia such as, for example, the words "ON" and "OFF" or positive (+) and negative (−) signs, which indicate non-tripped status of an electrical switching apparatus, are also contemplated by the invention.

As employed herein, the term "linking element" refers to any known or suitable mechanism for connecting one component to another and expressly includes, but is not limited to, rigid links (e.g., without limitation, arms; pins; rods), flexible links (e.g., without limitation, wires; chains; ropes), and resilient links (e.g., without limitation, springs).

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 2:
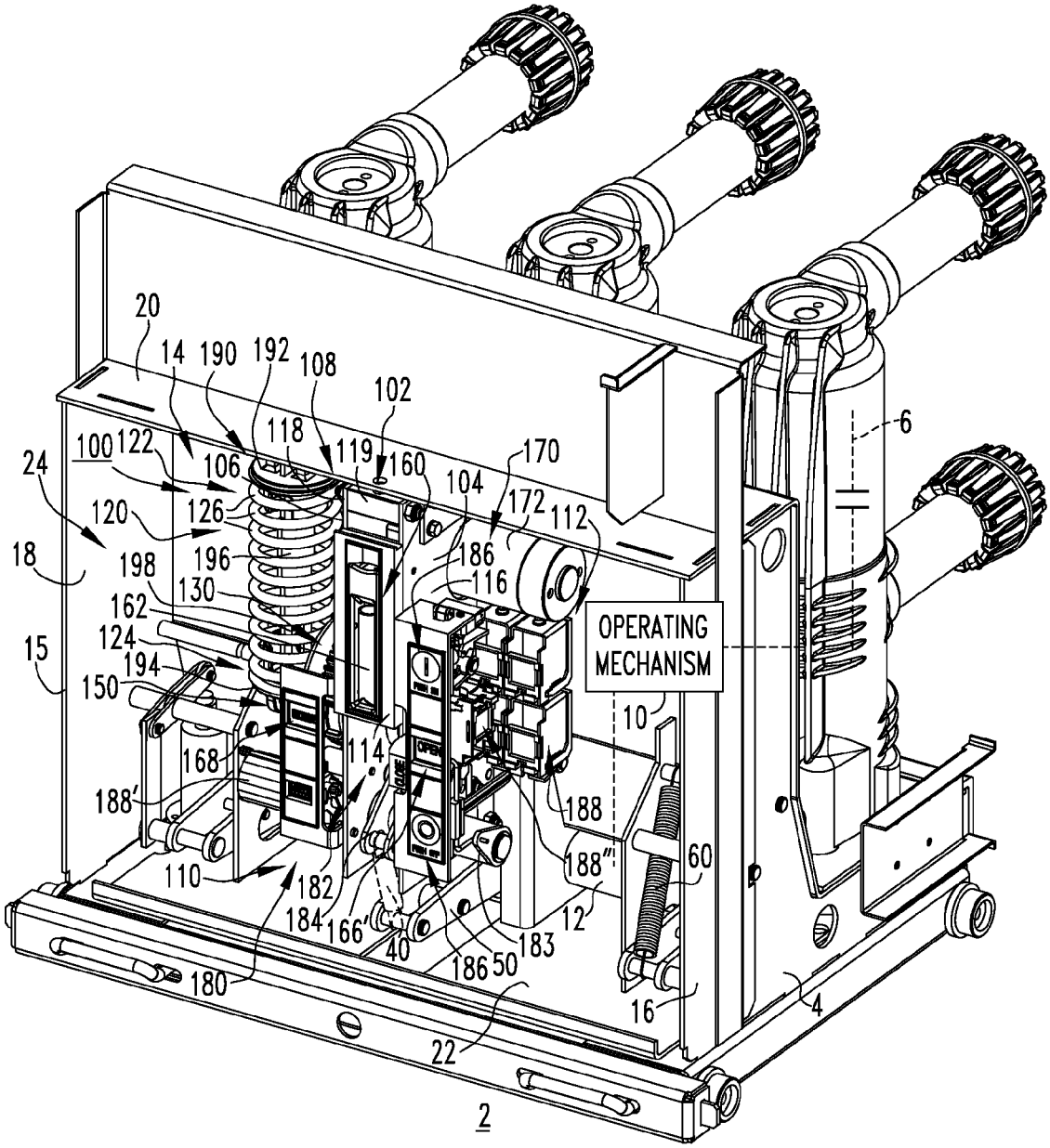
FIG. 2 is an isometric view of the circuit breaker and stored energy assembly therefor of FIG. 1, showing the stored energy assembly installed within the circuit breaker housing.

FIGS. 1 and 2 show a stored energy assembly 100 for an electrical switching apparatus such as, for example, a medium voltage circuit breaker 2. The circuit breaker 2 includes a housing 4, separable contacts 6 (shown in simplified form in hidden line drawing in FIG. 2), and an operating mechanism 10 (shown in simplified form in FIG. 2) structured to open and close the separable contacts 6 (FIG. 2). The example operating mechanism 10 (FIG. 2) includes a pivotable pole shaft 12, which generally extends between opposing sides 16,18 of the circuit breaker housing 4. In addition to the sides 16,18, the circuit breaker housing 4 also includes a back 14, a front 15, a top 20, and a bottom 22. The opposing sides 16,18, top 20, and bottom 22 extend outwardly from the back 14 to form a cavity 24. The stored energy assembly 100 includes a mount 102, which is structured to be removably coupled to the circuit breaker housing 4 such that the stored energy assembly 100 is disposed within the cavity 24, as shown in FIG. 2.

The mount 102 of the example stored energy assembly 100 includes a first side 104, a second side 106, first and second opposing ends 108,110, a back 112, which in the example shown and described herein is structured to be coupled to the back 14 of the circuit breaker housing 4, and a front 114, which is structured to be accessible at or about the front 15 of the circuit breaker housing 4 when the stored energy assembly 100 is disposed within the cavity 24, as shown in FIG. 2. The example mount 102 also includes first and second side plates 116,118 and a plurality of mounting blocks 119 disposed therebetween. A stored energy mechanism such as, for example, a spring 120, is coupled to the second side plate 118 on the second side 106 of the mount 102. The spring 120 is movable among a charged position (see, for example, FIGS. 8A and 8B) and a discharged position (FIGS. 1-5 and 7). A gear assembly 130, which includes a plurality of gears 132, 134,136 (all shown in FIGS. 3, 4 and 5), is also disposed on the second side 106 of the mount 102.

Figure 3:
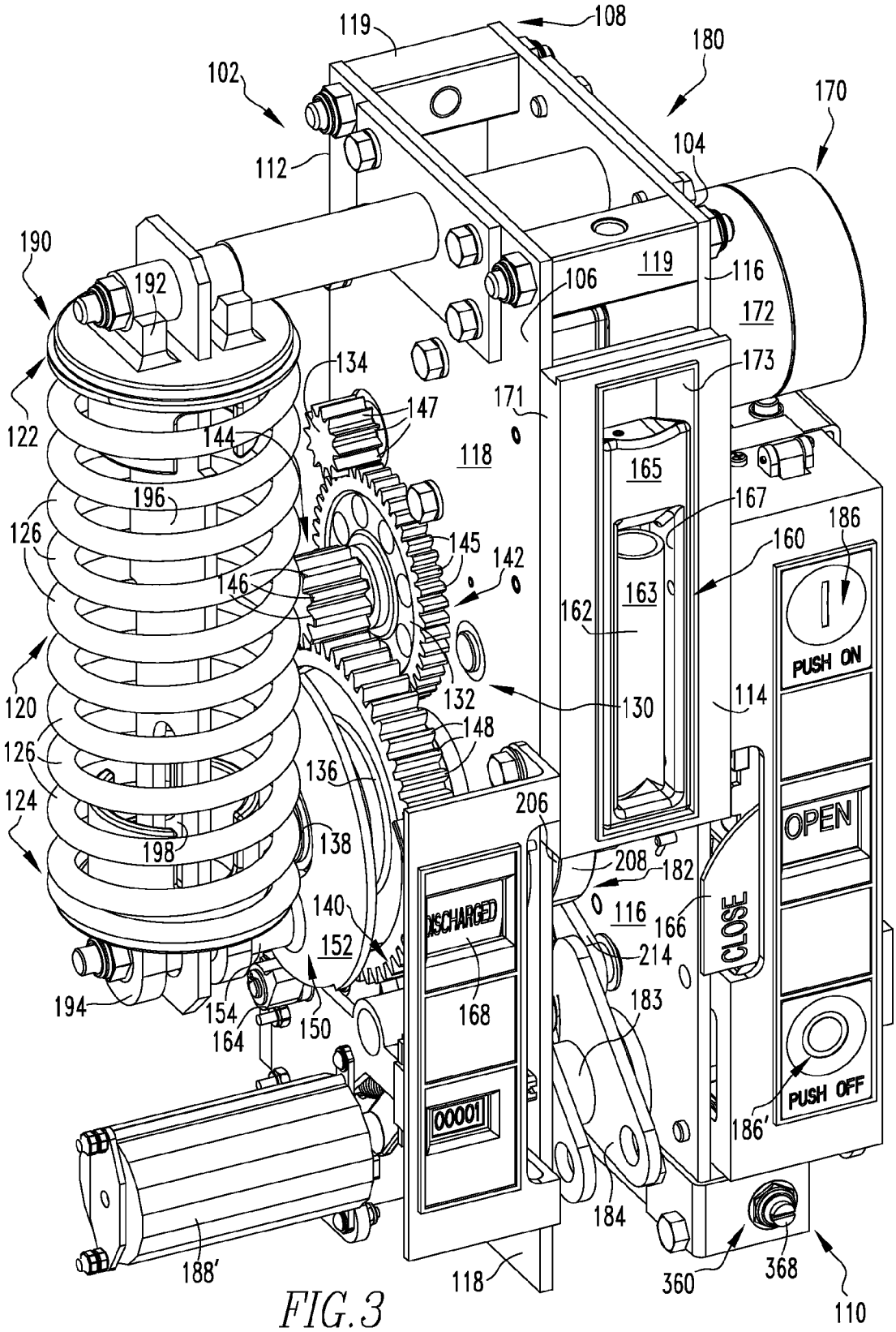
FIG. 3 is an isometric view of the stored energy assembly of FIG. 1.

As shown in FIG. 3, the gears 132,134,136 of the gear assembly 130 are operable to move the actuating element 150 to the first position of FIGS. 8A and 8B (discussed hereinbelow), thereby charging the spring 120. The actuating element 150 is also movable to the second position, shown in FIGS. 1-5 and 7, in which the spring 120 is disposed in the discharged position. The stored energy assembly 100 also includes a first charging mechanism 160 coupled to the gear 134, and a second charging mechanism 170, which is coupled to the same gear 134, although the invention is also applicable to such charging mechanisms coupled to any one of the plural gears 132,134,136.

Figure 4:
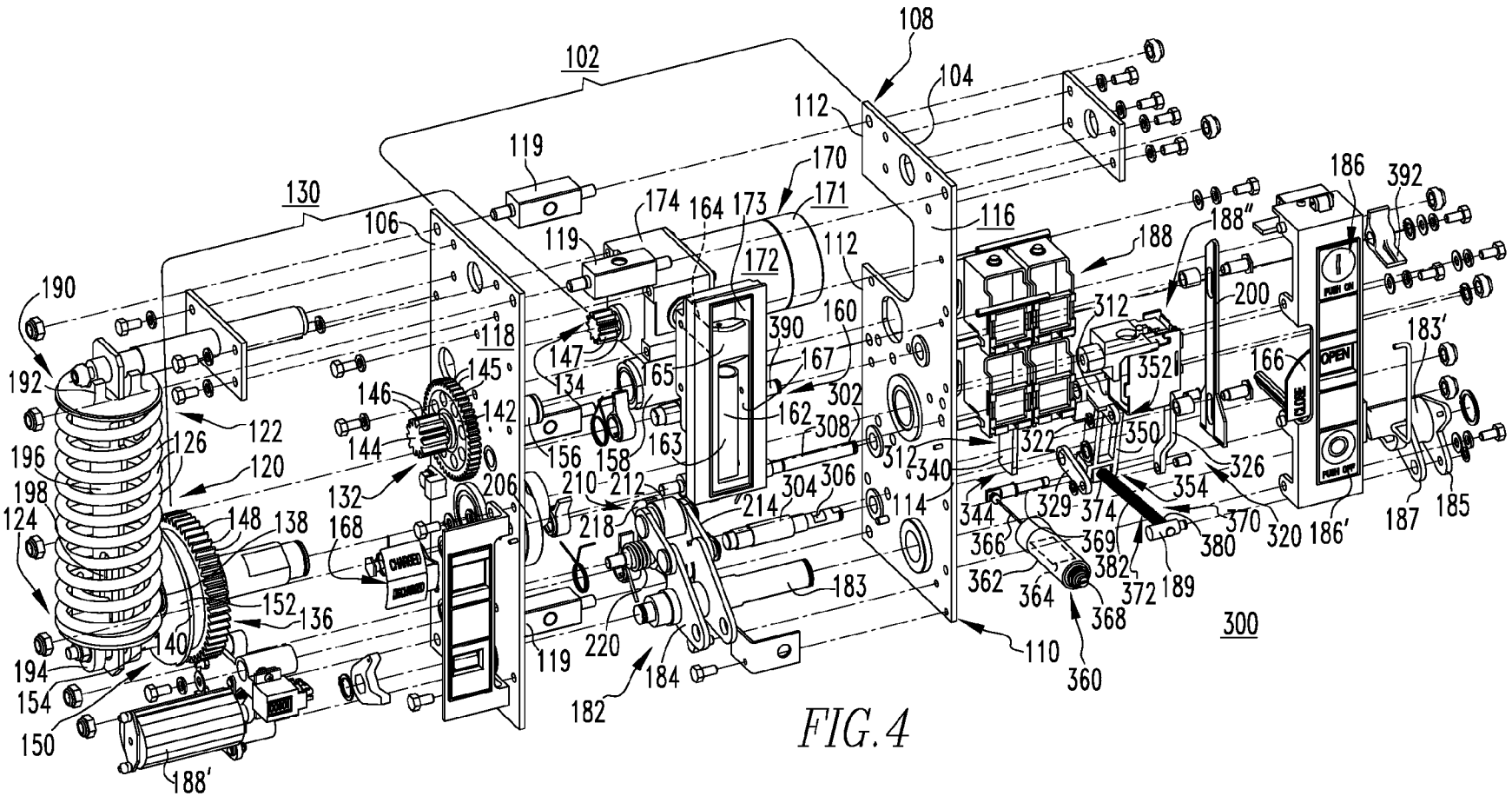
FIG. 4 is an exploded isometric view of the front of the stored energy assembly of FIG. 1.
Figure 5:
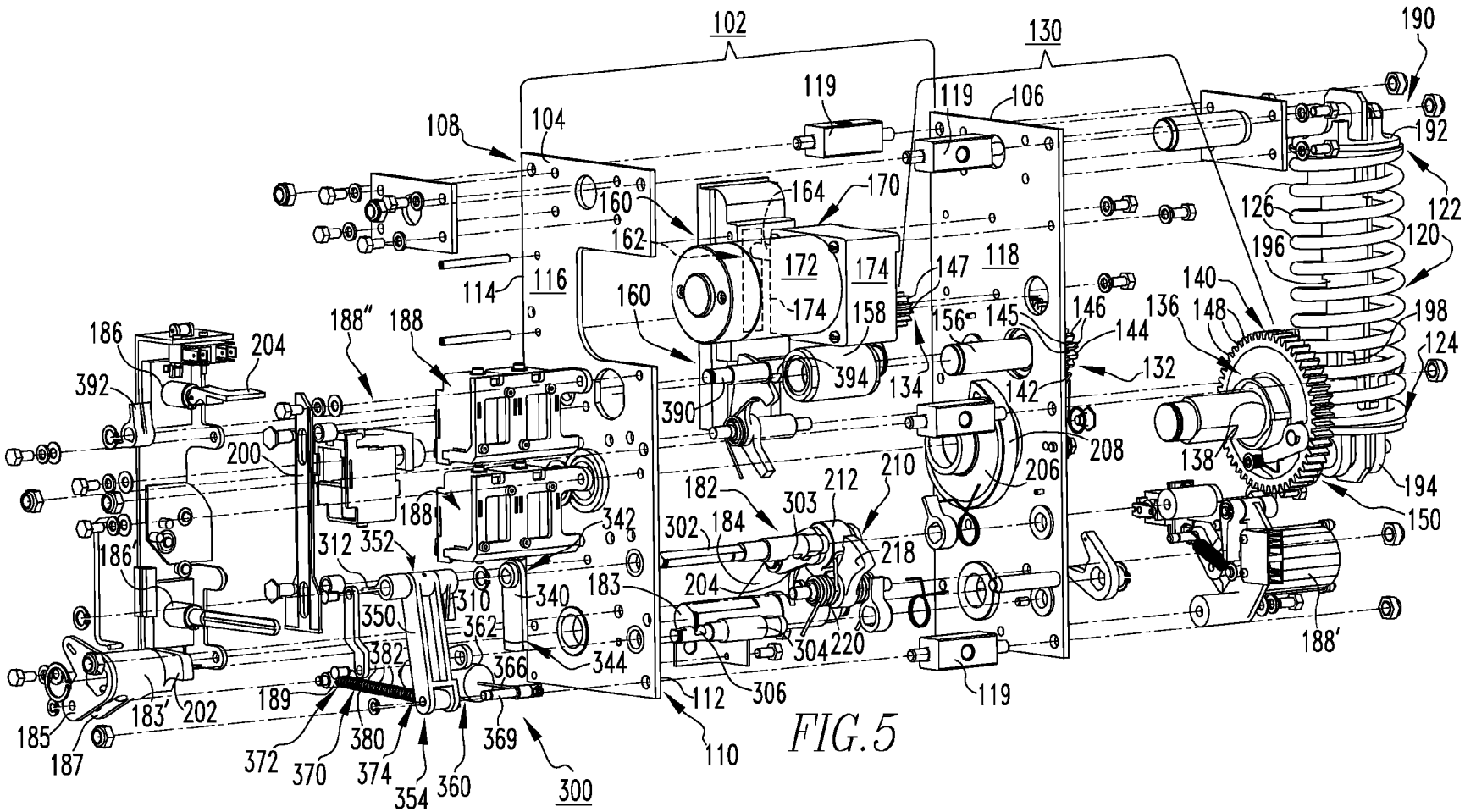
FIG. 5 is an exploded isometric view of the back of the stored energy assembly of FIG. 4.

More specifically, as best shown in FIGS. 4 and 5, the first and second charging mechanisms 160,170 of the example stored energy assembly 100 are both structured to be coupled to the second gear 134. Accordingly, both the first charging mechanism 160 and the second charging mechanism 170 move the second gear 134, in order to move all of the gears 132,134,136 of the gear assembly 130, which moves the actuating element 150 and charges the spring 120. In this regard, the disclosed stored energy assembly 100 is particularly advantageous, as it requires only one gear assembly 130 for operation of both the first charging mechanism, which in the example shown and described herein is a manual charging mechanism 160 including a charging handle 162, and the second charging mechanism, which in the example shown and described herein is an automatic charging mechanism 170 including an electric motor 170 and a gear box 174.

Figure 6:
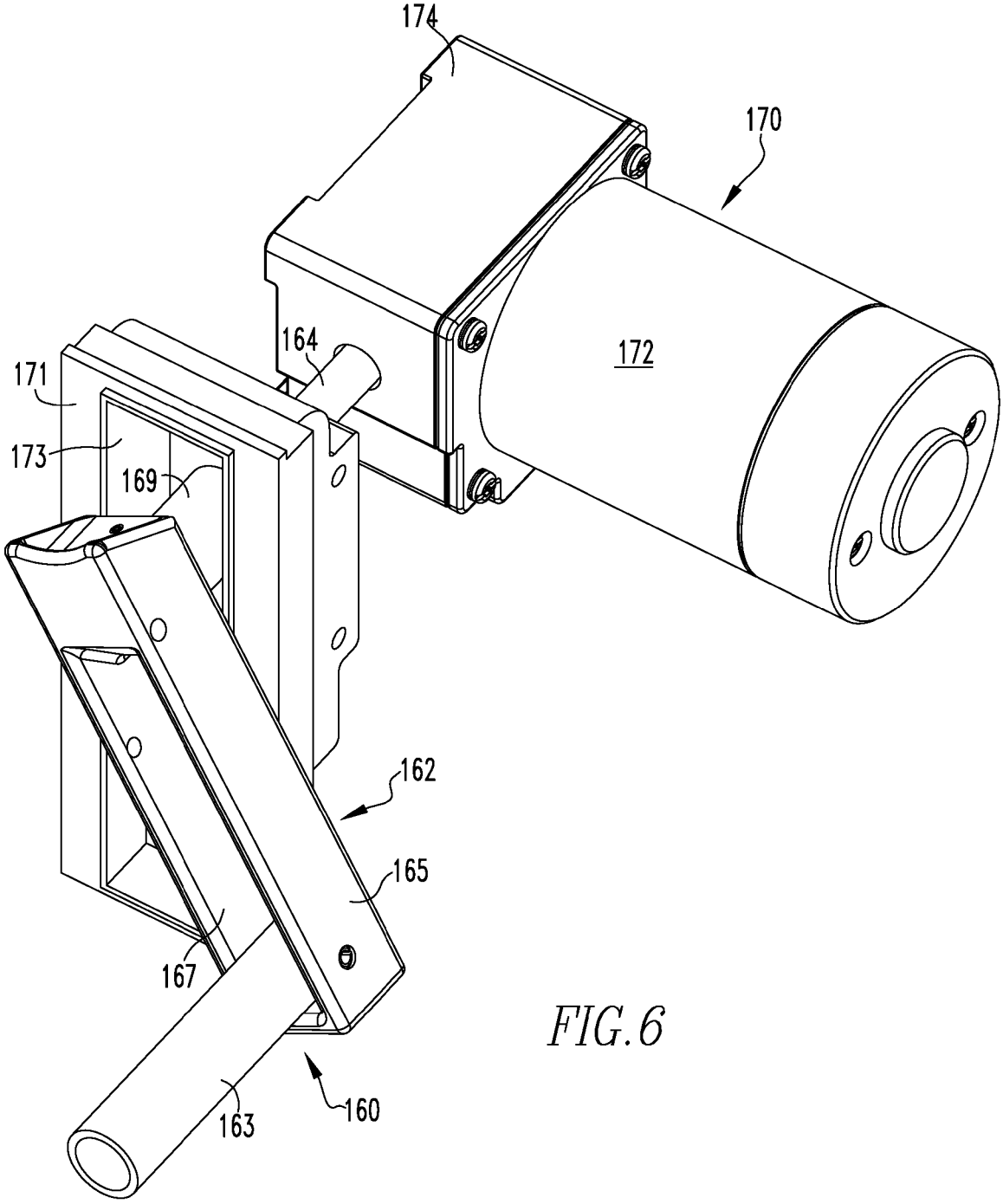
FIG. 6 is an isometric view of the charging handle for the stored energy assembly, in accordance with an embodiment of the invention.

The charging handle 162 of the example manual charging assembly 160 is coupled to a handle mount 171 disposed on the front 114 of the mount 102. More specifically, as shown in FIGS. 4 and 6, the disclosed charging handle 162 includes a grip 163, which is pivotably coupled to a crank 165. The crank 165, in turn, is coupled to the handle mount 171 by way of a shaft 169 (FIG. 6). The shaft 169 is coupled to a one-way bearing 164, which operates the aforementioned gear box 174 (internal gears not shown for simplicity of illustration), in order to turn the second gear 134 (FIGS. 3-5) of the gear assembly 130 (FIGS. 3-5). Accordingly, the gear box 174, and thus the second gear 134 which is coupled thereto, are operable both manually by rotating (e.g., clockwise with respect to FIG. 6) the charging handle 162 of the manual charging mechanism 160, and automatically by way of the electric motor 172 of the automatic charging mechanism 170. In other words, the manual charging mechanism 160 operates through the gear box 174 of the automatic charging mechanism 170, in order to move the gears 132,134,136 (FIGS. 3-5) of the gear assembly 130 (FIGS. 3-5) and the actuating element 150 (FIGS. 3-5) to charge the spring 120 (see, for example, charged spring 120 of FIGS. 8A and 8B).

This is, in large part, made possible by the one-way bearing 164, which pivotably couples the charging handle 162 to the gear box 174. Such one-way bearing is structured only to permit positive movement to manipulate the gear box 174, when the charging handle 167 is rotated in one, predetermined direction (e.g., clockwise with respect to FIG. 6). In other words, the one-way bearing 164 disengages positive interaction between the charging handle 162 and the gear box 174 when the charging handle 162 is rotated in the opposite direction (e.g., counterclockwise with respect to FIG. 6). The one-way bearing also functions to disengage the charging handle 162 when the electric motor 172 is operating. Thus, while the charging handle 162 and electric motor 172 are not intended to operate at the same time to turn the gear 134, they are each operable individually to do so. Such operation of the stored energy assembly 100 both manually and automatically through the same gear assembly 130, is an entirely new and distinct design from known stored energy mechanism designs, which typically employ separate and independent manual and automatic charging assemblies, each having a plurality of individual, unrelated components.

Also unique with respect to the disclosed manual charging mechanism 160 is the arrangement of the charging handle 162, which is relatively compact in design yet is effective to provide substantial leverage for manually charging the spring 120. The charging handle 162 also advantageously remains coupled to the stored energy assembly 100. More specifically, the charging handle 162, when not in use, is disposed in the position shown in FIG. 4, in which the grip 163 is pivoted to be stowed within a recess 167 of the crank 165. The crank 165 is, in turn, stowed within a recess 173 in the handle mount 171. When it is desired to manually charge the spring 120, the crank 164 and grip 163 can be unfolded to the operable position, shown in FIG. 6.

Accordingly, as shown, for example, in FIGS. 1-3, it will be appreciated that the spring 120, the actuating element 150, the gear assembly 130, and the first and second charging mechanisms 160,170, as well as the time delay mechanism 300 (discussed herein below with respect to FIGS. 4, 5, 7, 10A, 10B, 10C and 10D), are all coupled to the mount 102, in order that the stored energy assembly 100 forms an individual subassembly 180, that is structured to be removably coupled to the circuit breaker housing 4, as shown in FIG. 2.

More specifically, as best shown in FIGS. 3-5 and 7, a mounting assembly 190 is structured to mount the spring 120 on the second 106 of the mount 102, with the first end 122 of the spring 120 being disposed proximate the first end 108 of the mount 102, and the second end 124 of the spring 120 extending toward the second end 110 of the mount 102. A plurality of coils 126 extends between the first and second ends 122 and 124 of the spring 120. The example mounting assembly 190 includes a first connector 192 extending outwardly from the second side 106 of the mount 102 at or about the first end 108 of the mount 102, a second connector 194 coupled to the actuating element 150, and a guide member 196 extending from the first connector 192 toward the second connector 194. The spring 120 is disposed between the first and second connectors 192,194. The guide member 196 extends through the coils 126. Accordingly, when the actuating element 150 is moved toward the first position, shown in FIGS. 8A and 8B, the second connector 194 moves toward the first connector 192, in order to charge the spring 120. Conversely, when the actuating element 150 is moved toward the second position of FIG. 3, the second connector 194 moves away from the first connector 192 in order to discharge the spring 120.

The example gear assembly 130 includes three gears, a first gear 132 coupled to the second side 106 of the mount 102, the aforementioned second gear 134, which is coupled to the gear box 174 (FIGS. 4 and 5) of the automatic charging mechanism 170, and a third gear 136 coupled to the actuating element 150 and being cooperable with the first and second gears 132,134. Accordingly, as previously discussed, the manual charging mechanism 160 is coupled to the automatic charging mechanism 170, as best shown in FIG. 6, and is structured to move the automatic charging mechanism 170, in order to move the second gear 134. This, in turn, moves all of the gears 132,134,136 of the gear assembly 130, as well as the actuating element 150. Alternatively, the automatic charging mechanism 170 can independently move the second gear 134. The example third gear 136 includes a center 138 and a generally circular perimeter 140. The example actuating element 150 has a planar portion 152, and a protrusion 154 extending perpendicularly outwardly from the planar portion 152, as shown in FIGS. 3 and 4. The planar portion 152 is coupled to the third gear 136 such that the protrusion 154 is disposed between the center 138 and the generally circular perimeter 140 thereof. In this manner, when the third gear 136 is pivoted and the actuating element 150 is moved toward the first position (FIGS. 8A and 8B), the protrusion 154 of the actuating element 150 moves the second connector 194 in a first direction (e.g., upward with respect to FIG. 3) to compress the spring 120 to the position shown in FIGS. 8A and 8B. Conversely, when the third gear 136 is released (described below), the actuating element 150, which is coupled to the gear 136, rapidly moves (e.g., pivots) toward the second position of FIG. 3, such that the protrusion 154 of the actuating element 150 moves the second connector 194 in a second direction (e.g., downward with respect to FIG. 3), which is generally opposite the first direction, in order to release the spring 120. When the spring 120 is released, the gears 132, 134,136 of the gear assembly 130 rotate freely, thereby permitting the actuating element 150 and, in particular, the protrusion 154, to move rapidly. Operation of the stored energy assembly 100 and, in particular, the drive assembly 182 thereof, will be described in greater detail hereinbelow with respect to FIGS. 9A, 9B and 9C.

Continuing to refer to FIGS. 3 and 4, it will be appreciated that the example first gear 132 includes a first portion 142 and a second portion 144. Each of the first portion 142 of the first gear 132, the second portion 144 of the first gear 132, the second gear 134, and the third gear 136, has a plurality of teeth 145,146,147,148, respectively. The teeth 145 of the first portion 142 of the first gear 132 engage the teeth 147 of the second gear 134. The teeth 146 of the second portion 144 of the first gear 132 engage the teeth 148 of the third gear 136. Thus, when one of the gears 132,134,136 of the gear assembly 130 is moved, all of the gears 132,134,136 move, in order to move the actuating element 150, as previously described.

As shown in FIG. 5, the example gear assembly 130 further includes a shaft 156 coupled to and extending outwardly from the first gear 132, and a one-way clutch 158, which is coupled to the shaft 156. The one-way clutch 158 is structured to only permit each of the gears 132,134,136 to be operable in one direction. Thus, among other benefits, the one-way clutch 158 serves as a safety mechanism by preventing the spring 120 from being unintentionally released, for example, resulting in the charging handle 162 (shown in hidden line drawing in simplified form in FIG. 5) being pivoted rapidly, and potentially harming the operator (not shown). The one-way clutch 158 also serves to permit the spring 120 to be partially charged. That is, the spring 120 can be charged to any desired degree between the discharged position, shown for example in FIG. 5, and the fully charged position, shown in FIGS. 8A and 8B.

Figure 7:
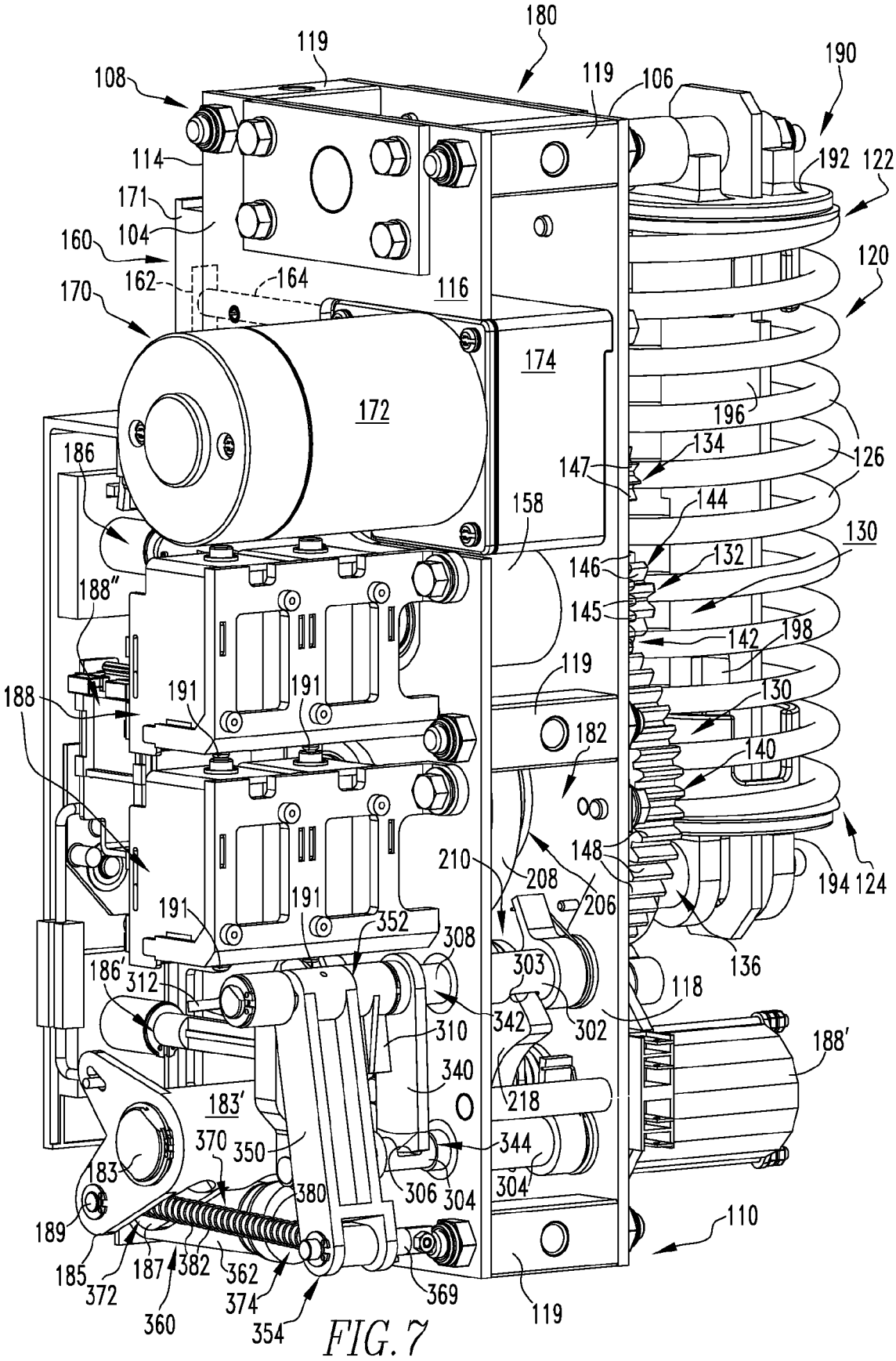
FIG. 7 is an assembled isometric view of the stored energy assembly of FIG. 4.
Figure 8B:
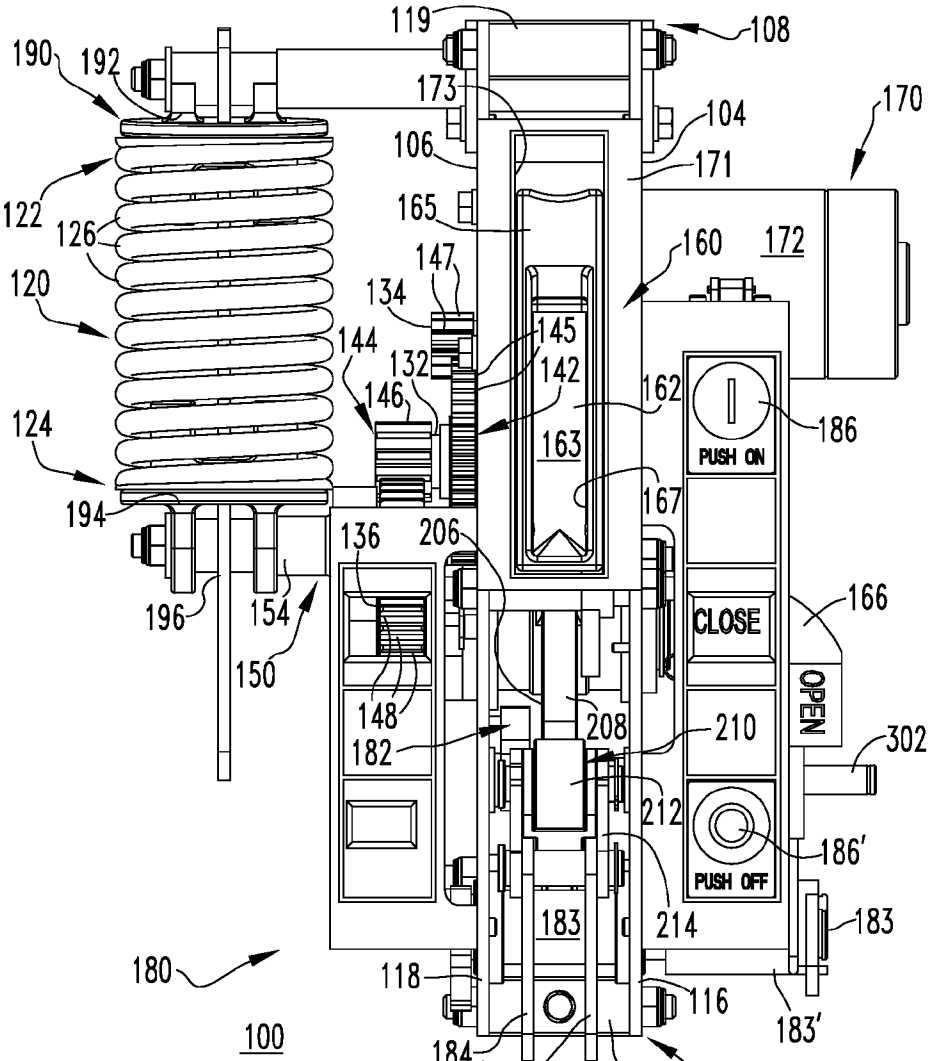
FIGS. 8A and 8B are side elevation and front elevation views, respectively, of the stored energy assembly of FIG. 1, modified to show the assembly in the closed and charged position.
Figure 8A:
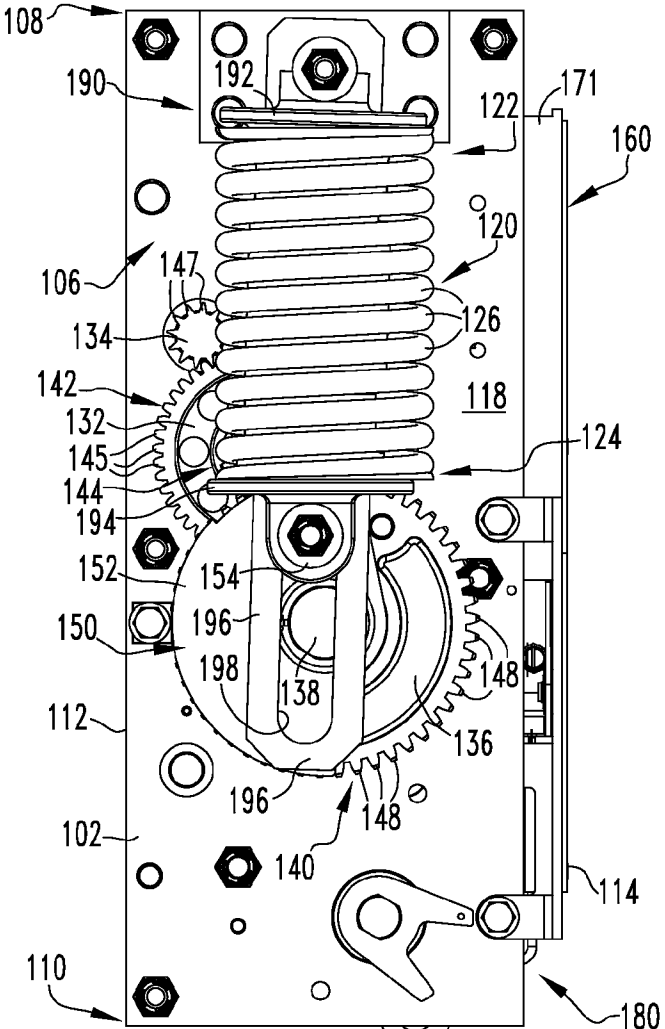

As best shown in FIG. 8A (see also FIGS. 1-5 and 7), the guide member 196 of the example mounting assembly 190 includes a slot 198. The protrusion 154 (FIGS. 3, 4, 7, 8A and 8B) of the actuating element 150, which in the example shown and described herein comprises a pin member, extends outwardly from the planar portion 152 of the actuating element 150, as shown in FIGS. 3, 4 and 8A, and as previously discussed, and through the slot 198 of the guide member 196. The pin member 154 is then coupled to the second connector 194 of the mounting assembly 190 using any known or suitable fastener or fastening mechanism, as defined herein.

Accordingly, the slot 198 enables the pin member 154 and the second connector 194 to be movable with respect to the guide member 196, so that the spring 120 may be compressed to the charged position shown in FIGS. 8A and 8B, or released to the discharged position, shown for example, in FIG. 3.

Accordingly, it will be appreciated that the disclosed stored energy assembly 100 provides an independent sub-assembly 180, which can be relatively quickly and easily removably coupled to the circuit breaker housing 4 using a plurality of fasteners, such as, for example and without limitation, the screws 30, which are shown in the example of FIG. 1. More specifically, the sub-assembly 180 includes the aforementioned mount 102, which has first and second side plates 116,118, as well as the manual charging mechanism 160 and automatic charging mechanism 170, which are both coupled to the mount 102, and are structured to charge the spring 120, which is also coupled to the mount 102. Specifically, the example automatic charging mechanism 170 includes the aforementioned electric motor 170 and gear box 174, wherein the electric motor 172 is substantially disposed on the first side 104 of the mount 102 at or about the first side plate 116 thereto. The gear box 174 is disposed between the first and second side plates 116,118.

Also previously discussed was the fact that both the manual charging mechanism 160 and the automatic charging mechanism 170 operate the same gear assembly 130 to charge the spring 120 (see, for example, charged spring 120 of FIGS. 8A and 8B). The gear assembly 130 is, in turn cooperable with a drive assembly 182 (FIGS. 1-5, 8B, 9A-9C, and 10A-10D) which, as will be discussed, is structured to move the actuating element 150, protrusion 154, and second connector 194 to release the stored energy of the spring 120 and move the pole shaft 12 (FIGS. 1 and 2) of the circuit breaker 2 (FIGS. 1 and 2). It will, therefore, be appreciated that the disclosed stored energy assembly 100 comprises a self-contained sub-assembly 180. It will further be appreciated that the design of such self-contained sub-assembly 180 significantly reduces the number of components from that which is typically required for stored energy mechanisms. For example and without limitation, in accordance with one embodiment of the invention, the total number of components of the stored energy assembly 100 is reduced to about 100 components, as compared to the 300 or more components typically required by stored energy assemblies of known medium voltage circuit breakers (not shown). It is the self-contained nature of the disclosed stored energy assembly 100, which makes this possible.

Additionally, by providing an independent, self-contained sub-assembly 180, the disclosed stored energy assembly 100 functions as a universal mechanism which can be relatively quickly and easily adapted for use in various applications and/or with a wide variety of circuit breakers. Specifically, the sub-assembly 180 can be quickly and easily coupled to the circuit breaker housing 4, by fastening the screws 30 (FIG. 1) to secure the mount 102 of the sub-assembly 180 within the cavity 24 of the circuit breaker housing 4, as shown in FIG. 2. The modular design also makes assembly, repair, replacement and/or maintenance of the stored energy assembly 100 relatively quick and easy in comparison, for example, with known medium voltage circuit breaker designs (not shown) wherein the individual components of the stored energy assembly or assemblies is/are typically built-into the circuit breaker housing, necessitating at least partial disassembly of the circuit breaker. It will also be appreciated that, as will be discussed in greater detail herein below, additional components such as, for example and without limitation, status indicators 166,168 (see, for example, first status indicator 166 and second status indicator 168 of FIGS. 1-4), actuators (see, for example, first and second buttons 186,186' of FIGS. 1-5, 7, 8B, and 10A), and accessories (see, for example, accessory 188 of FIGS. 1, 2, 4, 5, 7 and 10A, accessory 188' of FIGS. 1-5 and 7, and accessory 188" of FIGS. 4, 5 and 10A), can also be coupled to the mount 102 of the disclosed stored energy assembly 100. The example mount 102 includes a first status indicator 166 that is movable among a first position (FIGS. 1-4) in which it indicates the separable contacts 6 (FIG. 2) are open, and a second position (FIG. 8B) in which it indicates the separable contacts 6 (FIG. 2) are closed. A second status indicator 168 moves between first (FIG. 3) and second (not expressly shown) positions to indicate the status of the spring 120 as being discharged (FIG. 3) and charged (not expressly shown, but see FIG. 4), respectively. It will, however, be appreciated that any known or suitable alternative number, type and/or configuration of status indicators, actuators and/or accessories could be employed without departing from the scope of the invention.

Figure 9C:
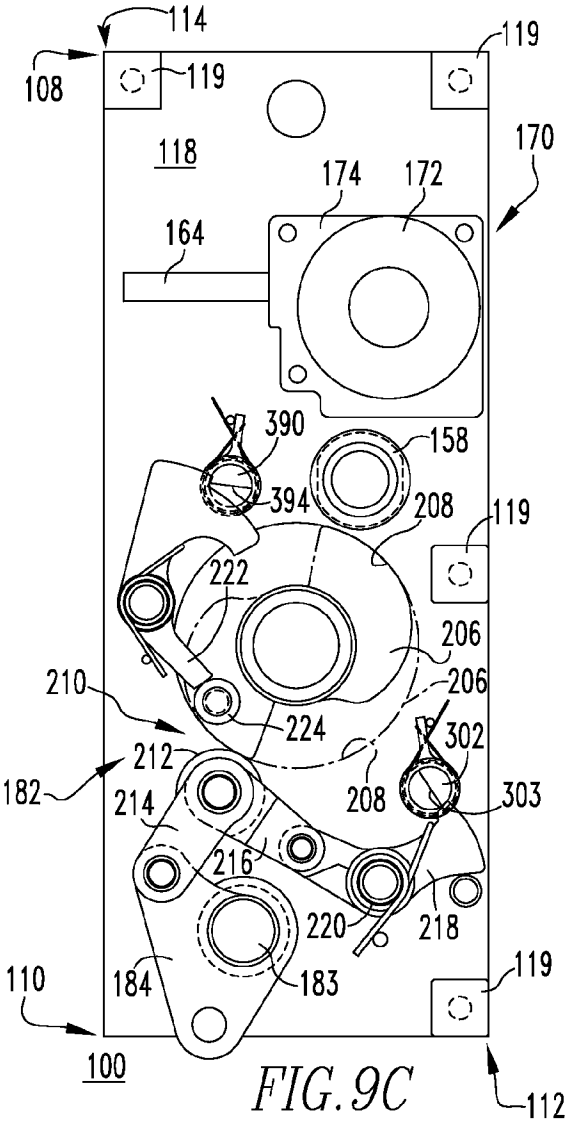
FIGS. 9A, 9B, and 9C are side elevation views of the drive assembly of the stored energy assembly of FIG. 1, respectively showing the components of the assembly in the open and discharged position, the open and charged position, and the closed and charged position.
Figure 9B:
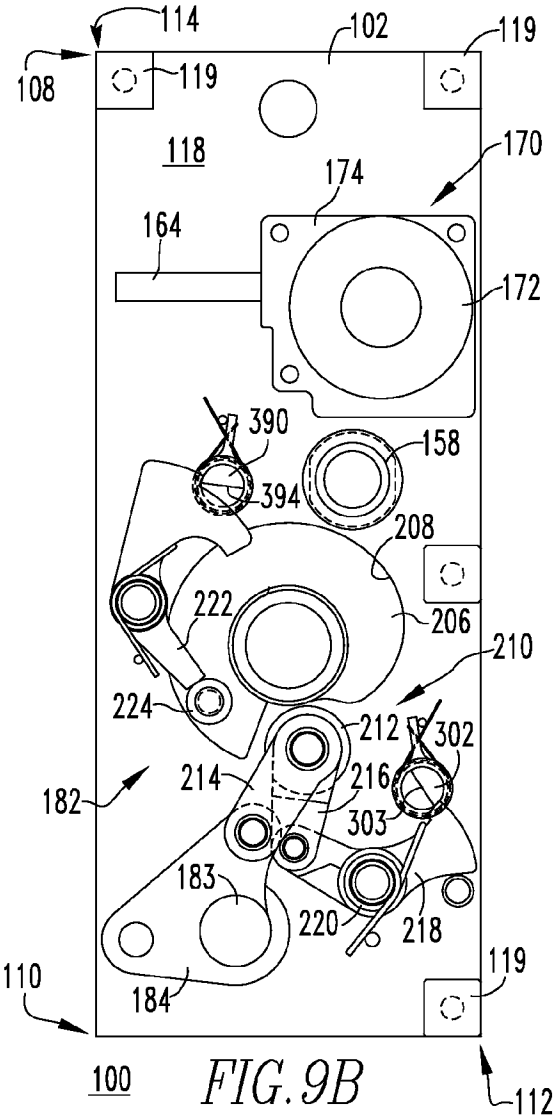
Figure 9A:
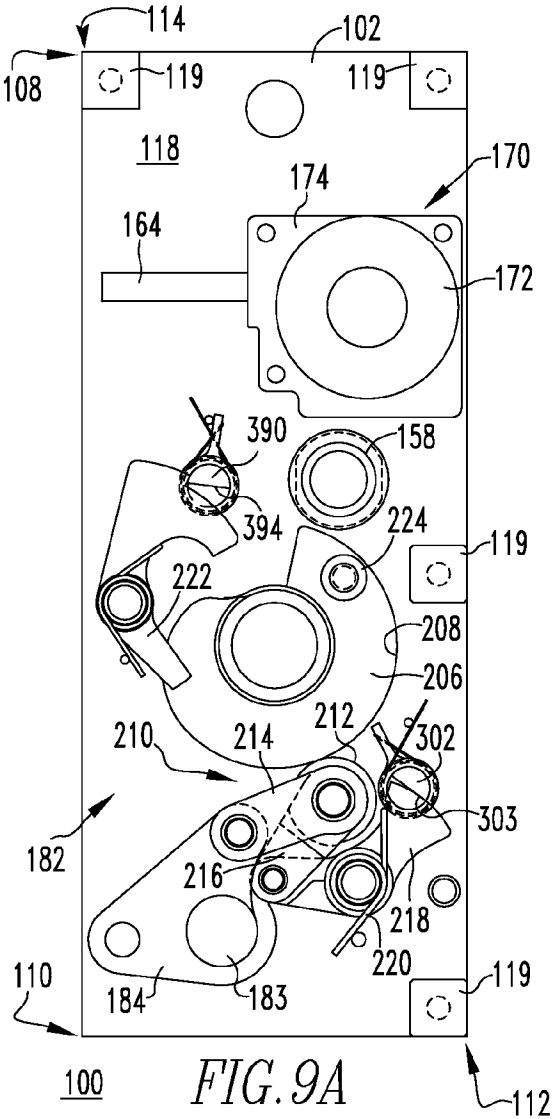

Operation of the drive assembly 182 to charge and discharge the spring 120 (FIGS. 1-5 and 7), as well as to move the pole shaft 12 (FIGS. 1 and 2) of the circuit breaker operating mechanism 10 (shown in simplified form in FIG. 2), in order to open and close the separable contacts 6 (shown in simplified form in hidden line drawing in FIG. 2), will now be discussed with reference to FIGS. 9A-9C. Specifically, FIGS. 9A-9C show the second side plate 118 of the mount 102 of the stored energy assembly 100, and the drive assembly 182 and automatic charging mechanism 170, which are disposed between the first and second side plates (first side plate 116 is removed in FIGS. 9A-9C for simplicity of illustration). The drive assembly 182 is shown in the open and discharged position in FIG. 9A, in the open and charged position in FIG. 9B, and in the closed and charged position in solid line drawing in FIG. 9C (see also cam 206 shown in the closed and discharged position in phantom line drawing in FIG. 9C). An end elevation view of the aforementioned one-way clutch 158, and a third trip shaft 390 (discussed hereinbelow), are also shown in each of FIGS. 9A-9C.

The example drive assembly 182 includes a drive shaft 183, which is pivotably coupled between the first and second side plates 116,118 (both shown in FIGS. 1-5, 7 and 8B), and an arm 184, which extends outwardly from the drive shaft 183. The arm 184 is structured to be coupled to the pole shaft 12 (FIGS. 1 and 2) of the circuit breaker operating mechanism 10 (shown in simplified form in FIG. 2) and, in particular, to an actuating arm 50, which extends outwardly from the pole shaft 12, by way of a suitable linking element 40 (shown in phantom line drawing in simplified form in FIG. 2), as shown in FIG. 2. Thus, the drive assembly 182 is structured to transfer the stored energy (e.g., when the spring 120 is released from the charged position of FIGS. 8A and 8B) from the spring 120 (FIGS. 1-5, 7, 8A and 8B) of the stored energy assembly 100, into movement of the pole shaft 12 (FIGS. 1 and 2) of the circuit breaker operating mechanism 10 (FIG. 2), in order to close the separable contacts 6 (shown in simplified form in hidden line drawing in FIG. 2) of the circuit breaker 2 (FIGS. 1 and 2), as desired. It will be appreciated that releasing the stored energy of the spring 120 also serves, for example, to charge a number of opening springs 60 (see, for example and without limitation, the single opening spring 60 shown in FIG. 2). It will, therefore, be appreciated that the drive assembly 182 is also movable to open the separable contacts 6 (FIG. 2), as will be discussed.

A portion of the arm 184, which is distal from the point of connection with the linking element 40 (FIG. 2), is pivotably coupled to a first toggle member 214 of a roller assembly 210, as shown in FIGS. 9A-9C. In addition to the first toggle member 214, the example roller assembly 210 further includes a roller 212, which is structured to be biased against the profile 208 of a pivotable cam 206, a second toggle member 216, which is pivotably coupled to the first toggle member 214, and a trip latch 218, which is biased between a trip position, shown in FIG. 9A, and a reset position, shown in FIGS. 9B and 9C. Specifically, the cam 206 is moveable among a first position, shown in FIG. 9A (see also the cam 206 shown in phantom line drawing in the first position in FIG. 9C), corresponding to the spring 120 (FIGS. 1-5, 7, 8A and 8B) of the stored energy assembly 100 being discharged (FIGS. 1-5 and 7), and a second position, shown in FIGS. 9B and 9C (shown in solid line drawing in FIG. 9C), corresponding to the spring 120 (FIGS. 1-5, 7, 8A and 8B) being charged (FIGS. 8A and 8B). The trip latch 218 is pivotably coupled to the second toggle member 216 and, therefore, is operable to move the second toggle member 216, roller 212, and first toggle member 214 of the roller assembly 210, in order to move (e.g., pivot counterclockwise with respect to FIGS. 9A and 9B; pivot clockwise with respect to FIG. 9C) the arm 184 of the drive assembly 182 about drive shaft 183. A bias element such as, for example and without limitation, the torsion spring 220 which is shown, biases the trip latch 218 towards the reset position (FIGS. 9B and 9C).

The drive assembly 182 also includes a first trip shaft 302 (discussed in greater detail hereinbelow), which includes a cut-out portion 303 structured to permit the trip latch 218 to be disengaged (FIG. 9A) and engaged (FIGS. 9B and 9C), respectively, with the first trip shaft 302, and a third trip shaft 390, which includes a cut-out portion 394 structured to releasably engage a catch 222 of the drive assembly 182. To close the separable contacts 6 (FIG. 2) of the circuit breaker (FIGS. 1 and 2), the third trip shaft 390 is pivoted, either manually or automatically, until the cut-out portion 394 releases the catch 222 of the drive assembly 182. This, in turn, releases a protrusion 224, which extends outwardly from the cam 206, thereby releasing the cam 206, which releases the spring 120 (FIGS. 1-5, 7, 8A and 8B) coupled thereto. In response, the cam 206 pivots (e.g., counterclockwise with respect to FIGS. 9A-9C) as it is driven by the stored energy of the spring 120 (FIGS. 1-5, 7, 8A and 8B), which has been released. Consequently, the perimeter 208 of the cam 206 cooperates with the roller 212 of the roller assembly 210 to move the drive arm 184 to the closed position of FIG. 9C.

To operate the drive assembly 182, for example, to open the separable contacts 6 (FIG. 2) of the circuit breaker 2 (FIGS. 1 and 2), the first trip shaft 302 is pivoted, either manually or automatically (discussed hereinbelow), to release the trip latch 218. In response, the roller assembly 210 and, in particular, the roller 212, which movably engages the perimeter 208 of the cam 206, move, thereby permitting the cam 206 to move. Thus, releasing the trip latch 218, moves the second toggle link 216, which moves the roller 212, thereby moving the cam 206 and the first toggle link 214, which moves the drive arm 184 to open the separable contacts 6 (FIG. 2). The opening spring(s) (e.g., without limitation, opening spring 60 of FIG. 2) facilitates such movement of the drive assembly 182 by biasing the pole shaft 12 (FIGS. 1 and 2) and, thus, the drive arm 184, which is coupled to the pole shaft 12 (FIGS. 1 and 2).

As shown in FIGS. 4, 5, 7, and 10A-10D, the stored energy assembly 100 may also include a time delay mechanism 300. The time delay mechanism 300 is structured to provide a delay from a first time, at which the first trip shaft 302 is initially moved from a first position, to a second time, at which a second trip shaft 304 (described hereinbelow) is moved to release a trip catch 340 (described hereinbelow). In this manner, a corresponding delay is achieved, for example, between the time an electrical fault condition initially occurs, and the time the separable contacts 6 (FIG. 2) of the circuit breaker 2 (FIGS. 1 and 2) trip open. The disclosed time delay mechanism 300 is also adjustable, in order that such delay can be controlled (e.g., shortened; lengthened), as desired.

The time delay mechanism 300 includes the first trip shaft 302, which is pivotably coupled between the side plates 116, 118 of the mount 102, and extends through the first side plate 116 on the first 104 of the mount 102, as shown in FIG. 7, and a second trip shaft 304, which is similarly pivotably coupled to the mount 102 proximate the first trip shaft 302. As previously discussed in connection to FIGS. 9A-9C, the first trip shaft 302 is cooperable with the drive assembly 182, and is movable among a first position (FIGS. 10B and 10C) corresponding to the spring 120 (FIGS. 1-5, 7, 8A and 8B) of the stored energy assembly 100 being charged (FIGS. 8A and 8B), and a second position (FIGS. 10A and 10D) corresponding to the spring (FIGS. 1-5, 7, 8A and 8B) being discharged (FIGS. 1-5 and 7).

Figure 10A:
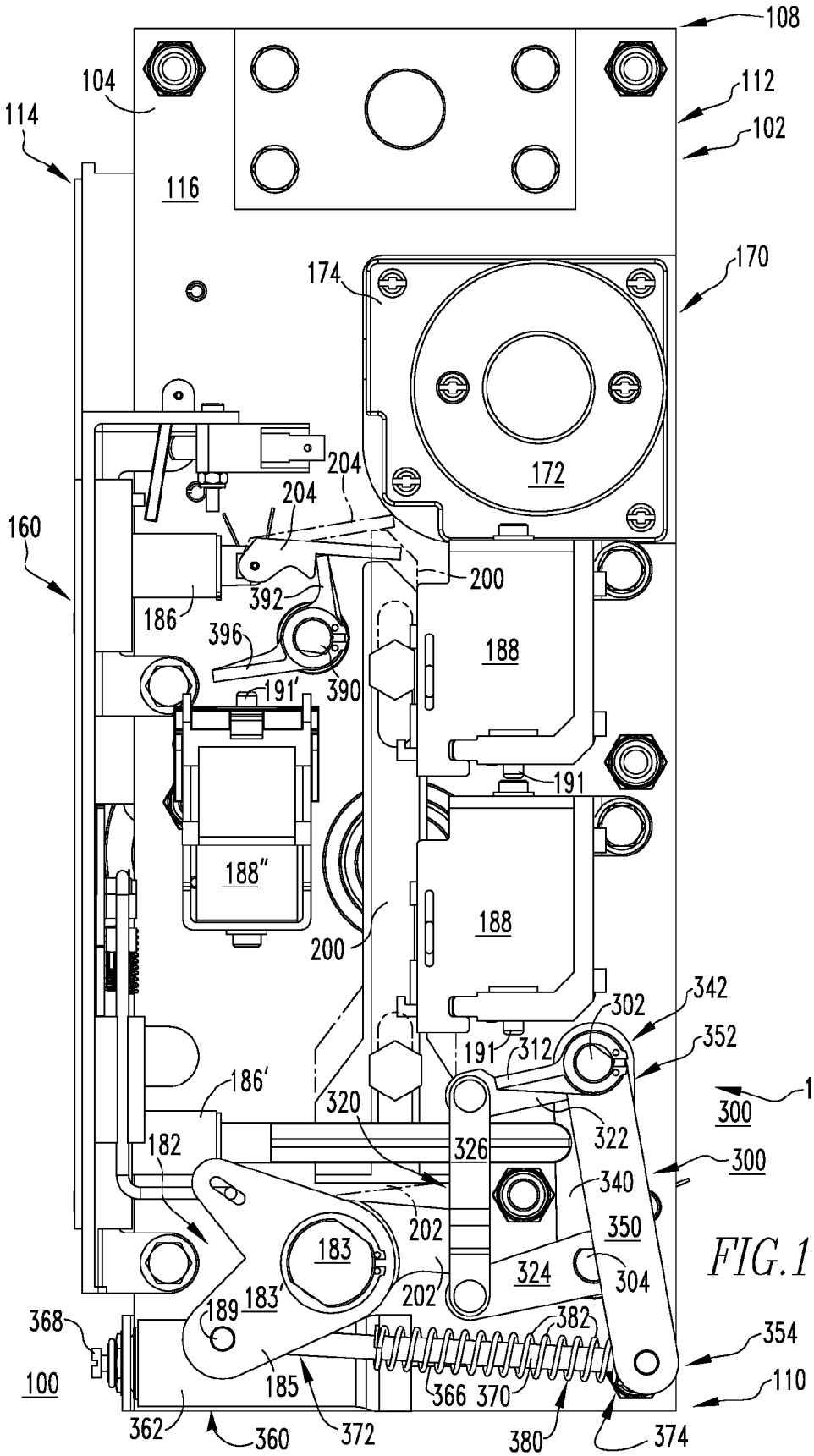
FIG. 10A is a side elevation view of the right side of the stored energy assembly and time delay mechanism therefor, showing the time delay mechanism in the open and discharged position.
Figure 10B:
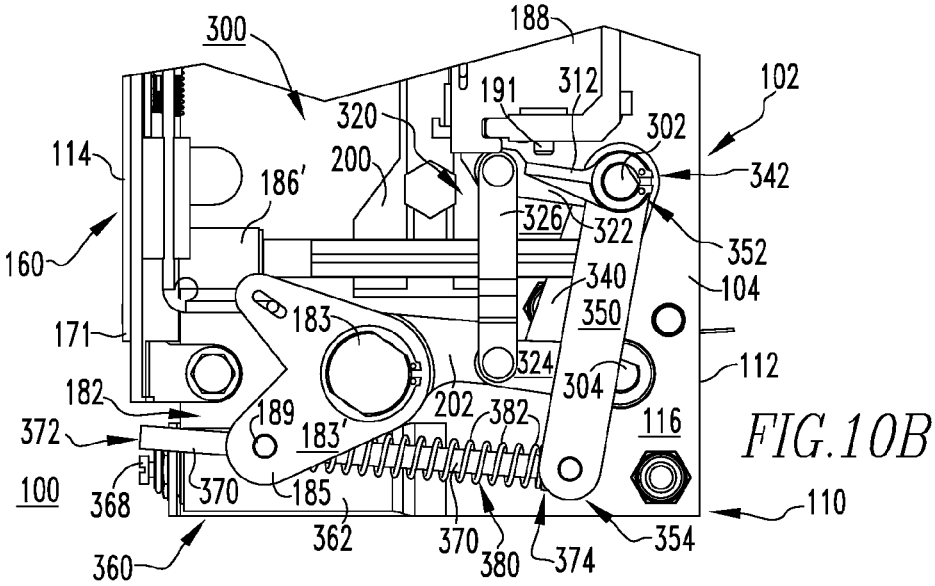
FIGS. 10B, 10C and 10D are side elevation views of the time delay mechanism of FIG. 10A, modified to respectively show the time delay mechanism in the open and charged position, the closed and charged position, and the closed and discharged position.
Figure 10C:
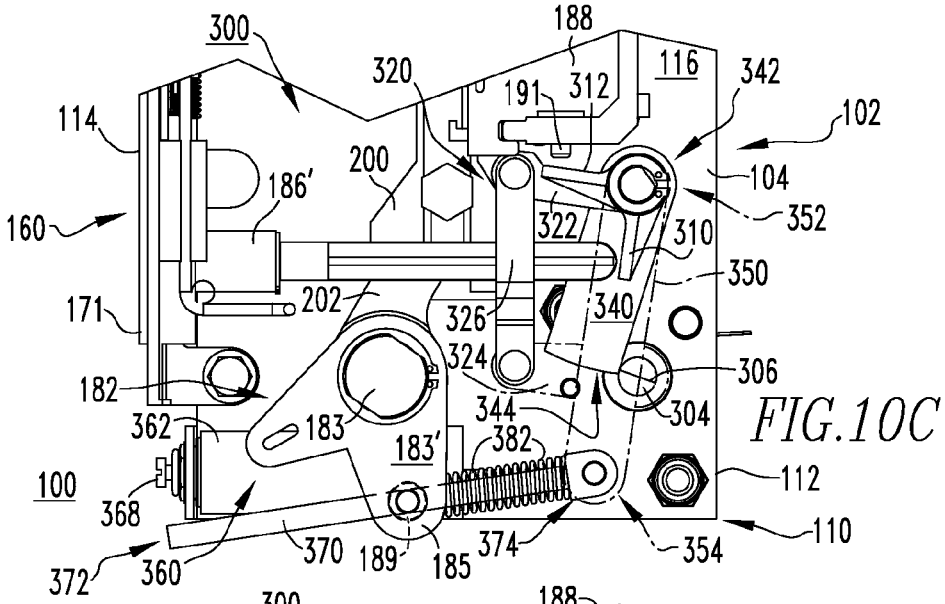
Figure 10D:
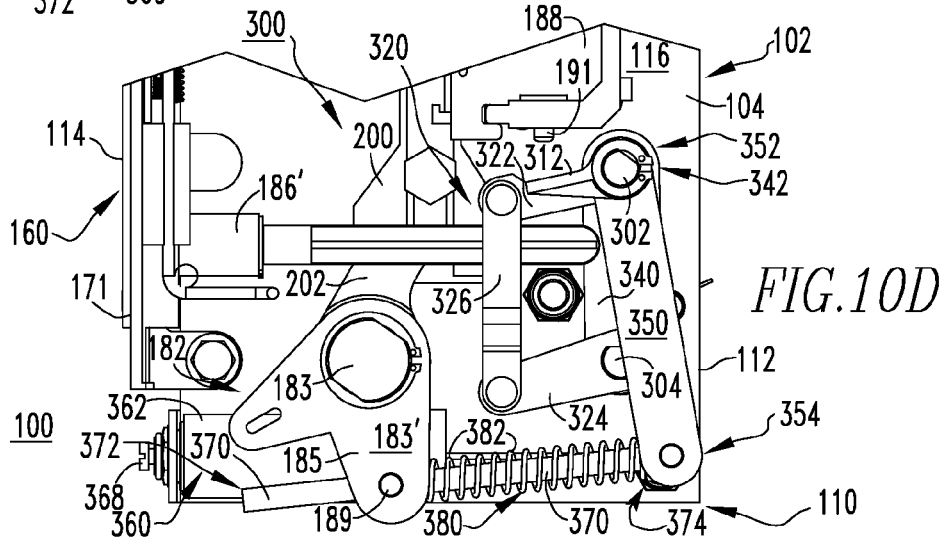

As shown in FIGS. 4, 5 and 10C, the second trip shaft 304 of the time delay mechanism 300 includes a cut-out portion 306, which is similar to the aforementioned cut-out portion 303 (FIGS. 5, 7, 9A, 9B and 9C) of the first trip shaft 302. A linking assembly 320 of the time delay mechanism 300 has a plurality of linking elements 322,324,326 that interconnect the first and second trip shafts 302,304, in order that movement of one of the first trip shaft 302 and the second trip shaft 304, results in movement of the other of the first trip shaft 302 and the second trip shaft 304. The aforementioned trip catch 340 includes a first end 342 coupled to the first trip shaft 302, and a second end 344, which is engageable with the second trip shaft 304. Hence, the trip catch 340 is movable with the first trip shaft 302, but not independently with respect thereto. The example time delay mechanism 300 also includes a drive lever 350 having a first end 352 coupled to the first trip shaft 302 and a second end 354 disposed opposite and distal from the first end 352. A damper 360 is coupled to the drive lever 350. It is the damper 360 that is adjustable in order to adjust the delay of the time delay mechanism 300, as will be discussed.

When the first trip shaft 302 is moved from the first position (e.g., charged) (FIGS. 10B and 10C), toward the second position (e.g., discharged) (FIGS. 10A and 10D), the first trip shaft 302 moves the linking elements 322,324,326 of the link assembly 320, thereby pivoting the second trip shaft 304. When the second trip shaft 304 is pivoted, the cut-out portion 306 (best shown in FIG. 10C) of the second trip shaft 304 releases the trip catch 340, thereby permitting the trip catch 340 and, thus, the first trip shaft 302 to move to the second position of FIGS. 10A and 10D. When the first trip shaft 302 moves to such second position, the trip latch (FIGS. 9A-9C) is released, in order to permit the opening spring (see, for example, opening spring 60 of FIG. 2) to move the pole shaft 12 (FIGS. 1 and 2), actuating arm 50 (FIG. 2), and linking element 40 (shown in phantom line drawing in FIG. 2) of the circuit breaker (FIGS. 1 and 2). This, in turn, moves the drive assembly 182 and permits the separable contacts (FIG. 2) to be opened, as previously discussed.

The linking elements of the example link assembly 320 include a first trip lever 322 extending outwardly from the first trip shaft 302, a second trip lever 324 extending outwardly from the second trip shaft 304 generally parallel with respect to the first trip lever 322, and a trip link 326 interconnecting the first and second trip levers 322,324, as shown. Both the linking elements 322,324,326 of the link assembly 320 and the damper 360 of the time delay mechanism 300, contribute to the aforementioned delay. The example damper is an air dashpot 360 including a reservoir 362 having a volume of air 364 (shown in simplified form in hidden line drawing in FIG. 4), a plunger 366 (best shown in FIGS. 4 and 5) extending outwardly from the reservoir 362, and an adjustment mechanism 368 (FIGS. 3, 4, 10A, 10B, 10C and 10D) for adjusting the volume of air 364 (FIG. 4) within the reservoir 362. The adjustment mechanism 368 of the example damper 360 is a fastener such as, for example and without limitation, a screw or bolt, which is adjustable in a first direction (e.g., tightened) in order to reduce the volume of air 364 (FIG. 4) within the reservoir 362 and thereby reduce the delay of the stored energy assembly 100, and in a second direction (e.g., loosened), in order to increase the volume of air 364 (FIG. 4) within the reservoir 362 and thereby increase such delay. The damper 360 also includes a connecting link 369, which couples the plunger 366 of the damper 360 to the drive lever 350 of the time delay mechanism 300, as shown in FIGS. 5 and 7.

In the example shown and described herein, the time delay mechanism 300 is substantially disposed on the first side 104 of the stored energy assembly 100. Also extending outwardly from the mount 102 of the stored energy assembly 100, on the first side thereof, is the drive shaft 183 of the aforementioned drive assembly 182 (see, for example, FIG. 7). The example drive shaft 183 includes an attachment 183' having at least one protrusion such as, for example and without limitation, the opposing protrusions 185,187, which are both shown in FIGS. 4, 5 and 7. A connector 370, which in the example shown and described herein is a drive rod, includes a first end 372 that is movably coupled to and extending through a trunnion 189, which is disposed between the opposing protrusions 185,187 of the drive shaft attachment 183'. The second end 374 of the drive rod 370 is coupled to the drive lever 350 of the time delay mechanism 300 at or about the second end 354 of the drive lever 350. A bias member such as, for example and without limitation, the spring 380, shown in FIGS. 4, 5, 7 and 10A-10D, is disposed between the trunnion 189 of the drive shaft attachment 183' and the drive lever 350. Specifically, the example spring 380 includes a plurality of coils 382, with the drive rod 370 extending through such coils 382. Thus, the spring 380 biases the drive lever 350 away from the drive shaft 183, and thereby biases the first trip shaft 302 toward the second position (FIGS. 10A and 10D), in order to maintain positive engagement between the first trip shaft 302 and the components (e.g., without limitation, linking elements 322,324,326) of the time delay mechanism 300.

Accordingly, it will be appreciated that the disclosed time delay mechanism 300 is coupled to the mount 102 of the stored energy assembly 100, thereby forming part of the aforementioned independent sub-assembly 180 (see, for example, FIG. 10A) that is removably coupled to the circuit breaker housing 4, as shown in FIGS. 1 and 2.

In order to actuate the drive assembly 182, the example stored energy assembly 100 includes at least one actuator 186,186',188,188',188" (all shown in FIG. 7). Specifically, the example stored energy assembly 100 includes at least one manual actuator such as, for example and without limitation, the first (e.g., ON) button 186 and second (e.g., OFF) 186' button, which are manually actuatable from the front 114 of the stored energy assembly 100 and extend toward the back 112 of the stored energy assembly 100, in order to be cooperable with a corresponding trip shaft (see, for example, first button 186 and pivot member 204 thereof, which are cooperable to move tab 392 of third trip shaft 390 in FIGS. 5 and 10A; see also second button 186' extending toward the back 112 of the mount 102 in order to be cooperable with the trip paddle 310 of first trip shaft 302 in FIGS. 5 and 10C) (see also FIGS. 1-3 and 8B showing the front of the first and second buttons 186,186'), and at least one accessory 188 (FIGS. 1, 2, 4, 5, 7 and 10A-10-D), 188' (FIGS. 1-5 and 7), 188" (FIGS. 2, 4, 5, 7 and 10A), which are operable automatically to move the corresponding trip shaft (e.g., 302,390). For example, as shown in FIGS. 10A-10D, the example stored energy assembly 100 includes a number of shunt trip devices 188. Each of the shunt trip devices 188 has a corresponding actuating element such as, for example and without limitation, the stem 191, which is shown, that is structured to engage and move a corresponding trip paddle 312 disposed on the body 308 of the first trip shaft 302, for example, in response to the detection of the electrical fault condition. Another accessory 188", also includes a stem 191', which is actuatable to engage and move a tab 396 of the third trip shaft 390, in order to close the separable contacts 6 (FIG. 2) of the circuit breaker 2 (FIGS. 1 and 2) automatically, for example, from a remote location.

The pivot member 204 of the first (e.g., ON) button 186 is pivotably coupled to the end of the first button 186, as shown in FIG. 10A. An interlock 200 is movably coupled to the first side 104 of the mount 102 of the stored energy assembly 100, and is movable among a first position (shown in solid line drawing in FIG. 10A) corresponding to the tab 392 of the third trip shaft 390 being movable by the movable member 204 of the first button 186, and a second position (shown in phantom line drawing in FIG. 10A) corresponding to the tab 392 of the third trip shaft 390 not being movable by the actuation of the first button 186. Specifically, when the interlock 200 is disposed in the second position, shown in phantom line drawing in FIG. 10A, the interlock moves the pivot member 204 of the first button 186 to the corresponding position, which is also shown in phantom line drawing in FIG. 10A. The interlock 200 and pivot member 204 are moved to these positions by pivotable protrusion 202 of the drive shaft attachment 183' (partially shown in phantom line drawing in FIG. 10A; see also FIGS. 10C and 10D). Specifically, when the drive shaft 183 and attachment 183' thereof are moved to the position (FIGS. 10C and 10D) corresponding to the separable contacts 6 (FIG. 2) of the circuit breaker 2 (FIGS. 1 and 2) being closed, the pivotable protrusion 202 engages and moves (e.g., upwards with respect to FIG. 10A) the interlock 200 to the position shown in phantom line drawing in FIG. 10A. Accordingly, the interlock 200 prevents the first button 186 from being actuated to undesirably re-release the spring 120 (FIGS. 1-5, 7, 8A and 8B) after it has already been discharged to move the drive assembly 182 and close the circuit breaker separable contacts 6 (FIG. 2).

Accordingly, it will be appreciated that the disclosed time delay mechanism 300 provides many benefits. Among them, is the fact that it is adjustable, in order to adjust the delay in the operation of the stored energy assembly 100, as desired. It is also comprised of a relatively few number of parts and it is mechanical in nature, making it reliable and relatively inexpensive to make. Additionally, the time delay mechanism 300 is entirely coupled to the mount 102 of the stored energy assembly 100, thereby maintaining the advantageous self-contained modular design of the stored energy assembly 100. As such, the stored energy assembly 100 can be relatively quickly and easily adapted for use in various applications, and with a wide variety of different electrical switching apparatus (e.g., without limitation, medium-voltage circuit breakers).

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A stored energy assembly for an electrical switching apparatus including a housing, said stored energy assembly comprising:

a mount structured to be removeably coupled to said housing;

a stored energy mechanism coupled to said mount and being movable among a charged position and a discharged position;

a gear assembly including a plurality of gears;

an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position;

a first charging mechanism coupled to a corresponding one of said gears;

a second charging mechanism coupled to said corresponding one of said gears, wherein each of said first charging mechanism and said second charging mechanism is structured to move said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is structured to be removeably coupled to said housing of said electrical switching apparatus;

wherein said mount comprises a first side, a second side, a first end, a second end disposed opposite and distal from the first end, a back structured to be coupled to said housing, and a front structured to be accessible external said housing; wherein said stored energy mechanism comprises a spring and a mounting assembly structured to mount said spring on the second side of said mount; wherein said spring has a first end disposed proximate the first end of said mount, a second end extending toward the second end of said mount and a plurality of coils extending between the first end of said spring and the second end of said spring;

wherein said mounting assembly comprises a first connector extending outwardly from the second side of said mount at or about the first end of said mount, a second connector coupled to said actuating element, and a guide member extending between said first connector and said second connector; wherein said spring is disposed between said first connector and said second connector wherein said guide member extends through said coils; wherein, when said actuating element is moved toward said first position, said second connector is structured to move toward said first connector in order to charge said spring; and wherein, when said actuating element is moved toward said second position, said second connector is structured to move away from said first connector in order to discharge said spring;

wherein said first charging mechanism is a manual charging mechanism being operable by hand to charge said spring; wherein said second charging mechanism is an automatic charging mechanism being operable to automatically charge said spring; wherein said gears include a first gear coupled to the second side of said mount, a second gear coupled to said automatic charging mechanism, and a third gear coupled to said actuating element and being cooperable with said first gear and said second gear; and wherein said manual charging mechanism is coupled to said automatic charging mechanism and is structured to move said automatic charging mechanism in order to move said second gear; and wherein said third gear includes a center and a generally circular perimeter; wherein said actuating element comprises a planar portion and a protrusion extending perpendicularly outwardly from said planar portion; wherein said planar portion is coupled to said third gear with said protrusion being disposed between said center and said generally circular perimeter; wherein, when said third gear is pivoted and said actuating element is moved toward said first position, said protrusion of said actuating element moves said second connector in a first direction to compress said spring; and wherein, when said third gear is pivoted and said actuating element is moved toward said second position, said protrusion of said actuating element moves said second connector in a second direction which is generally opposite said first direction, in order to release said spring.

2. A stored energy assembly for an electrical switching apparatus including a housing, said stored energy assembly comprising:

a mount structured to be removeably coupled to said housing;

a stored energy mechanism coupled to said mount and being movable among a charged position and a discharged position;

a gear assembly including a plurality of gears;

an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position;

a first charging mechanism coupled to a corresponding one of said gears;

a second charging mechanism coupled to said corresponding one of said gears, wherein each of said first charging mechanism and said second charging mechanism is structured to move said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is structured to be removeably coupled to said housing of said electrical switching apparatus;

wherein said mount comprises a first side, a second side, a first end, a second end disposed opposite and distal from the first end, a back structured to be coupled to said housing, and a front structured to be accessible external said housing; wherein said stored energy mechanism comprises a spring and a mounting assembly structured to mount said spring on the second side of said mount; wherein said spring has a first end disposed proximate the first end of said mount, a second end extending toward the second end of said mount, and a plurality of coils extending between the first end of said spring and the second end of said spring;

wherein said mounting assembly comprises a first connector extending outwardly from the second side of said mount at or about the first end of said mount, a second connector coupled to said actuating element, and a guide member extending between said first connector and said second connector; wherein said spring is disposed between said first connector and said second connector; wherein said guide member extends through said coils; wherein, when said actuating element is moved toward said first position, said second connector is structured to move toward said first connector in order to charge said spring; and wherein, when said actuating element is moved toward said second position, said second connector is structured to move away from said first connector in order to discharge said spring;

wherein said first charging mechanism is a manual charging mechanism being operable by hand to charge said spring; wherein said second charging mechanism is an automatic charging mechanism being operable to automatically charge said spring; wherein said gears include a first gear coupled to the second side of said mount, a second gear coupled to said automatic charging mechanism, and a third gear coupled to said actuating element and being cooperable with said first gear and said second gear; and wherein said manual charging mechanism is coupled to said automatic charging mechanism and is structured to move said automatic charging mechanism in order to move said second gear; and wherein said first gear includes a first portion and a second portion; wherein each of said first portion of said first gear, said second portion of said first gear, said second gear; and said third gear has a plurality of teeth; wherein said teeth of said first portion of said first gear engage said teeth of said second gear; wherein said teeth of said second portion of said first gear engage said teeth of said third gear, and wherein, when one of said gears of said gear assembly is moved, all of said gears move in order to move said actuating element.

3. A stored energy assembly for an electrical switching apparatus including a housing, said stored energy assembly comprising:

a mount structured to be removeably coupled to said housing;

a stored energy mechanism coupled to said mount and being movable among a charged position and a discharged position;

a gear assembly including a plurality of gears;

an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position;

a first charging mechanism coupled to a corresponding one of said gears;

a second charging mechanism coupled to said corresponding one of said gears, wherein each of said first charging mechanism and said second charging mechanism is structured to move said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is structured to be removeably coupled to said housing of said electrical switching apparatus;

wherein said mount comprises a first side, a second side, a first end, a second end disposed opposite and distal from the first end, a back structured to be coupled to said housing, and a front structured to be accessible external said housing; wherein said stored energy mechanism comprises a spring and a mounting assembly structured to mount said spring on the second side of said mount; wherein said spring has a first end disposed proximate the first end of said mount, a second end extending toward the second end of said mount, and a plurality of coils extending between the first end of said spring and the second end of said spring;

wherein said mounting assembly comprises a first connector extending outwardly from the second side of said mount at or about the first end of said mount, a second connector coupled to said actuating element, and a guide member extending between said first connector and said second connector; wherein said spring is disposed between said fast connector and said second connector; wherein said guide member extends through said coils; wherein, when said actuating element is moved toward said first position, said second connector is structured to move toward said first connector in order to charge said spring; and wherein, when said actuating element is moved toward said second position, said second connector is structured to move away from said first connector in order to discharge said spring.

wherein said first charging mechanism is a manual charging mechanism being operable by hand to charge said spiing; wherein said second charging mechanism is an automatic charging mechanism being operable to automatically charge said spring; wherein said gears include a first gear coupled to the second side of said mount, a second gear coupled to said automatic charging mechanism, and a third gear coupled to said actuating element and being cooperable with said first gear and said second gear; and wherein said manual charging mechanism is coupled to said automatic charging mechanism and is structured to move said automatic charging mechanism in order to move said second gear; and wherein said manual charging mechanism comprises a charging handle and a one-way bearing; wherein said automatic charging mechanism comprises an electric motor; wherein said one-way bearing is disposed between said charging handle and said electric motor; wherein said one-way bearing permits said charging handle to move said electric motor and said second gear only when said charging handle is moved in one predetermined direction; wherein said gear assembly further includes a shaft coupled to a corresponding one of said gears, and a one-way clutch coupled to said shaft; and wherein said one-way clutch only permits each of said first gear, said second gear, and said third gear to be operable in one direction.

4. A stored energy assembly for an electrical switching apparatus including a housing, said stored energy assembly comprising:

a mount structured to be renroveably coupled to said housing;

a stored energy mechanism coupled to said mount and being movable among a charged position and a discharged position;

a gear assembly including a plurality of gears;

an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position;

a first charging mechanism coupled to a corresponding one of said gears;

a second charging mechanism coupled to said corresponding one of said gears, wherein each of said first charging mechanism and said second charging mechanism is structured to move said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is structured to be removeably coupled to said housing of said electrical switching apparatus;

wherein said mount comprises a first side, a second side, a first end, a second end disposed opposite and distal from the first end, a back structured to be coupled to said housing, and a front structured to be accessible external said housing; wherein said stored energy mechanism comprises a spring and a mounting assembly structured to mount said spring on the second side of said mount; wherein said spring has a first end disposed proximate the first end of said mount, a second end extending toward the second end of said mount, and a plurality of coils extending between the first end of said spring and the second end of said spring;

wherein said mounting assembly comprises a first connector extending outwardly from the second side of said mount at or about the first end of said mount, a second connector coupled to said actuating element, and a guide member extending between said first connector and said second connector; wherein said spring is disposed between said first connector and said second connector; wherein said guide member extends through said coils; wherein, when said actuating element is moved toward said first position, said second connector is structured to move toward said first connector in order to charge said spring; and wherein, when said actuating element is moved toward said second position, said second connector is structured to move away from said first connector in order to discharge said spring; and wherein said guide member includes a slot; wherein said actuating element comprises a pin member extending outwardly from a corresponding one of said gears of said gear assembly; and wherein said pin member extends through said slot and is coupled to said second connector, in order that said pin member and said second connector are movable with respect to said guide member.

5. A stored energy assembly for an electrical switching apparatus including a housing, said stored energy assembly comprising:

a mount structured to be removeably coupled to said housing;

a stored energy mechanism coupled to said mount and being movable among a charged position and a discharged position;

a gear assembly including a plurality of gears;

an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position;

a first charging mechanism coupled to a corresponding one of said gears;

a second charging mechanism coupled to said corresponding one of said gears, wherein each of said first charging mechanism and said second charging mechanism is structured to move said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is structured to be removeably coupled to said housing of said electrical switching apparatus;

wherein said mount comprises a first side, a second side, a first end, a second end disposed opposite and distal from the first end, a back structured to be coupled to said housing, and a front structured to be accessible external said housing; wherein said stored energy mechanism comprises a spring and a mounting assembly stmctured to mount said spring on the second side of said mount; wherein said spring has a first end disposed proximate the first end of said mount, a second end extending toward the second end of said mount, and a plurality of coils extending between the first end of said spring and the second end of said spring; and wherein said mount further comprises a first side plate, a second side plate disposed opposite said first side plate, and a number of mounting blocks disposed between said first side plate and said second side plate; wherein said first charging mechanism is a manual charging mechanism including a charging handle; and wherein said charging handle is pivotably coupled to said front of said mount between said first side plate and said second side plate.

6. The stored energy assembly of claim 5 wherein said second charging mechanism is an automatic charging mechanism including an electric motor and a gearbox; wherein said electric motor is substantially disposed on the first side of said mount at or about said first side plate; and wherein said gearbox is disposed between said first side plate and said second side plate.

7. An electrical switching apparatus comprising:

a housing;

separable contacts;

an operating mechanism comprising a pivotable pole shaft structured to open and close said separable contacts; and a stored energy assembly comprising:

a mount removeably coupled to said housing, a stored energy mechanism coupled to said mount and being movable among a charged position and a discharged position, a gear assembly including a plurality of gears, an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position, a first charging mechanism coupled to a corresponding one of said gears, a second charging mechanism coupled to said corresponding one of said gears, wherein each of said first charging mechanism and said second charging mechanism moves said gears, in order to move said actuadng element and charge said stored energy mechanism, and wherein said stored energy mechanism, said actuating element, said gear assembly, said first charging mechanism, and said second charging mechanism are coupled to said mount, thereby forming a sub-assembly which is removeably coupled to said housing of said electrical switching apparatus;

wherein said mount of said stored energy assembly comprises a first side, a second side, a first end, a second end disposed opposite and distal from the first end, a back, and a front; wherein said stored energy mechanism of said stored energy assembly comprises a spring and a mounting assembly; wherein said spring has a first end disposed proximate the first end of said mount, a second end extending toward the second end of said mount, and a plurality of coils extending between the first end of said spring and the second end of said spring; wherein said mounting assembly comprises a first connector extending outwardly from the second side of said mount at or about the first end of said mount, a second connector coupled to said actuating element, and a guide member extending between said first connector and said second connector; wherein said spring is disposed between said first connector and said second connector; wherein said guide member extends through said coils of said spring; wherein, when said actuating element is moved toward said first position, said second connector moves toward said first connector in order to charge said spring; and wherein, when said actuating element is moved toward said second position, said second connector moves away from said first connector in order to discharge said spring; and wherein said first charging mechanism of said stored energy assembly is a manual charging mechanism being operable by hand to charge said spring; wherein said second charging mechanism of said stored energy assembly is an automatic charging mechanism being operable to automatically charge said spring; wherein said gears of said gear assembly of said stored energy assembly include a first gear coupled to the second side of said mount, a second gear coupled to said automatic charging mechanism and said manual charging mechanism, and a third gear including a center and a generally circular perimeter; wherein said third gear is cooperable with said first gear and said second gear; wherein said actuating element comprises a planar portion and a protrusion extending perpendicularly outwardly from said planar portion; wherein said planar portion is coupled to said third gear with said protrusion being disposed between said center and said generally circular perimeter; wherein, when said third gear is pivoted and said actuating element is moved toward said first position, said actuating element moves said second connector in a first direction to compress said spring; and wherein, when said third gear is pivoted and said actuating element is moved toward said second position, said actuating element moves said second connector in a second direction which is generally opposite said first direction, in order to release said spring.

8. The electrical switching apparatus of claim 7 wherein said first gear includes a first portion and a second portion; wherein each of said first portion of said first gear, said second portion of said first gear, said second gear, and said third gear has a plurality of teeth; wherein said teeth of said first portion of said first gear engage said teeth of said second gear; wherein said teeth of said second portion of said first gear engage said teeth of said third gear; and wherein, when one of said gear of said gear assembly is moved, all of said gears of said gear assembly move in order to move said actuating element.

9. The electrical switching apparatus of claim 7 wherein said manual charging mechanism of said stored energy assembly comprises a charging handle and a one-way bearing; wherein said automatic charging mechanism comprises an electric motor; wherein said one-way bearing is disposed between said charging handle and said electric motor; wherein said one-way bearing permits said charging handle to move said electric motor and said second gear only when said charging handle is moved in one predetermined direction; wherein said gear assembly further includes a shaft coupled to a corresponding one of said gears, wherein said one-way clutch only permits each of said first gear, said second gear, and said third gear to be operable in one direction.

10. An electrical switching apparatus comprising:

a housing;

separable contacts;

an operating mechanism comprising a pivotable pole shaft structured to open and close said separable contacts; and a stored energy assembly comprising:

a mount removeably coupled to said housing, a stored energy mechanism coupled to said mount and being movable among a charged position and a discharged position, a gear assembly including a plurality of gears, an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position, a first charging mechanism coupled to a corresponding one of said gears, a second charging mechanism coupled to said corresponding one of said gears, wherein each of said first charging mechanism and said second charging mechanism moves said gears, in order to move said actuating element and charge said stored energy mechanism, and wherein said stored energy mechanism, said actuating element, said gear assembly, said first charging mechanism, and said second charging mechanism are coupled to said mount, thereby forming a sub-assembly which is removeably coupled to said housing of said electrical switching apparatus;

wherein said mount of said stored energy assembly comprises a first side, a second side, a first end, a second end disposed opposite and distal from the first end, a back, and a front; wherein said stored energy mechanism of said stored energy assembly comprises a spring and a mounting assembly; wherein said spring has a first end disposed proximate the first end of said mount, a second end extending toward the second end of said mount, and a plurality of coils extending between the first end of said spring and the second end of said spring; wherein said mounting assembly comprises a first connector extending outwardly from the second side of said mount at or about the first end of said mount, a second connector coupled to said actuating element, and a guide member extending between said first connector and said second connector; wherein said spring is disposed between said first connector and said second connector; wherein said guide member extends through said coils of said spring;

wherein, when said actuating element is moved toward said first position, said second connector moves toward said first connector in order to charge said spring; and wherein, when said actuating element is moved toward said second position, said second connector moves away from said first connector in order to discharge said spring; and wherein said mount of said stored energy assembly further comprises a first side plate, a second side plate disposed opposite said first side plate, and number of mounting blocks disposed between said first side plate and said second side plate; wherein said first charging mechanism of said stored energy assembly is a manual charging mechanism including a charging handle; wherein said charging handle is pivotably coupled to said front of said mount between said first side plate and said second side plate; wherein said second charging mechanism is an automatic charging mechanism including an electric motor and a gearbox; wherein said electric motor is substantially disposed on the first side of said mount at or about said first side plate; and wherein said gearbox is disposed between said first side plate and said second side plate.

11. The electrical switching apparatus of claim 10 wherein said stored energy assembly further comprises a drive assembly including a drive shaft extending between said first side plate and said second side plate proximate the second end of said mount, and an actuating arm extending outwardly from said drive shaft; wherein said actuating arm is coupled to said pole shaft of said operating mechanism of said electrical switching apparatus; and wherein said drive shaft is cooperable with said actuating element and said gear assembly of said stored energy assembly, is structured to move said pole shaft.

12. An electrical switching apparatus comprising:

a housing;

separable contacts;

an operating mechanism comprising a pivotable pole shaft structured to open and close said separable contacts; and a stored energy assembly comprising:

a mount removeably coupled to said housing, a stored energy mechanism coupled to said mount and being movable among a charged position and a discharged position, a gear assembly including a plurality of gears, an actuating element being cooperable with said gears in order to charge said stored energy mechanism, said actuating element being movable among a first position corresponding to said stored energy mechanism being disposed in said charged position, and a second position corresponding to said stored energy mechanism being disposed in said discharged position, a first charging mechanism coupled to a corresponding one of said gears, a second charging mechanism coupled to said corresponding one of said gears, wherein each of said first charging mechanism and said second charging mechanism moves said gears, in order to move said actuating element and charge said stored energy mechanism, wherein said stored energy mechanism, said actuating element, said gear assembly, said first charging mechanism, and said second charging mechanism are coupled to said mount, thereby forming a sub-assembly which is rernoveably coupled to said housing of said electrical switching apparatus;

wherein said stored energy assembly further comprises at least one manual actuator and at least one accessory; and wherein each of said at least one manual actuator and said at least one accessory is actuatable in order to actuate said stored energy mechanism of said stored energy assembly; and wherein said stored energy assembly further comprises a first status indicator and a second status indicator; wherein said first status indicator is coupled to said at least one actuator; wherein said first status indicator is movable among a first position in which said first status indicator indicates said separable contacts of said electrical switching apparatus are open, and a second position in which said first status indicator indicates said separable contacts of said electrical switching apparatus are closed; wherein said second status indicator is cooperable with said actuating element; and wherein said second status indicator is movable among a first position in which said second status indicator indicates said stored energy mechanism of said stored energy assembly is charged, and a second position in which said second status indicator indicates said stored energy mechanism of said stored energy assembly is discharged.

* * * * *